US007614892B2

(12) United States Patent
Klant et al.

(10) Patent No.: US 7,614,892 B2
(45) Date of Patent: Nov. 10, 2009

(54) ELECTRICAL PLUG/SOCKET ADAPTOR

(75) Inventors: Keesjan Klant, Hillegom (NL); Tung Yan Lau, Flat E, 5/F., Block 7, Royal Ascot, Fotan, Shatin, N.T. (HK)

(73) Assignee: Tung Yan Lau, Hong Kong (HK)

( * ) Notice: Subject to any disclaimer, the term of this patent is extended or adjusted under 35 U.S.C. 154(b) by 0 days.

(21) Appl. No.: 11/970,915

(22) Filed: Jan. 8, 2008

(65) Prior Publication Data

US 2009/0029581 A1 Jan. 29, 2009

Related U.S. Application Data

(60) Provisional application No. 60/951,739, filed on Jul. 25, 2007, provisional application No. 60/980,868, filed on Oct. 18, 2007.

(51) Int. Cl.
*H01R 29/00* (2006.01)

(52) U.S. Cl. ..... 439/172

(58) Field of Classification Search ..... 439/172, 439/171, 145, 137, 651, 169–170, 173; 200/10, 200/339, 329

See application file for complete search history.

(56) References Cited

U.S. PATENT DOCUMENTS

| | | | | |
|---|---|---|---|---|
| 4,997,381 | A * | 3/1991 | Oh | 439/172 |
| 5,791,921 | A * | 8/1998 | Lee | 439/172 |
| 6,190,184 | B1 * | 2/2001 | Cimbal et al. | 439/131 |
| 6,382,996 | B1 * | 5/2002 | Eyman | 439/172 |
| 6,780,033 | B2 * | 8/2004 | Liu | 439/172 |
| 6,780,034 | B2 * | 8/2004 | Shiroshita et al. | 439/174 |
| 7,052,298 | B1 * | 5/2006 | Cheng | 439/171 |
| 7,303,416 | B1 * | 12/2007 | Liao | 439/173 |

* cited by examiner

*Primary Examiner*—Alexander Gilman
(74) *Attorney, Agent, or Firm*—Ostrolenk Faber LLP

(57) ABSTRACT

An electrical plug/socket adaptor for establishing an electrical connection between a electrical plug and an electrical socket, said adaptor comprising a housing with at least one electrical plug receiving zone to receive an electrical plug of a kind selected from at least one of a Euro pin electrical plug, British pin electrical plug, North America pin electrical plug, and Australia pin electrical plug, the adaptor configurable to itself be capable of being operatively plugged into an electrical socket of a kind selected from at least two of a Euro pin electrical socket, British pin electrical socket, North America pin electrical socket, and Australia pin electrical socket.

63 Claims, 45 Drawing Sheets

FIGURE 18
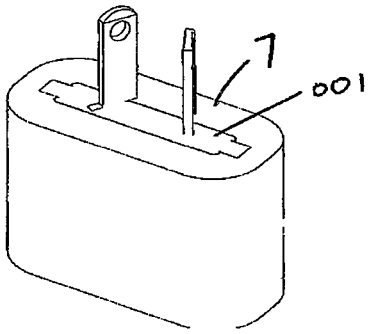
FIGURE 20
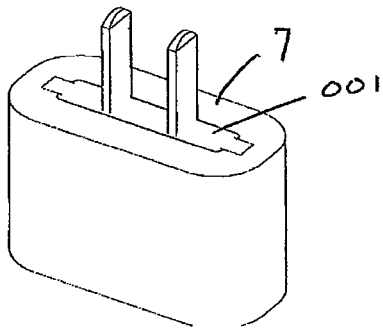
FIGURE 19
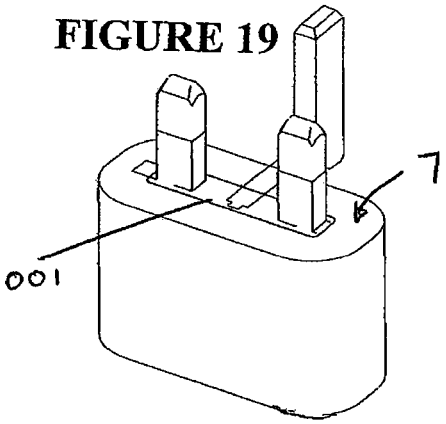
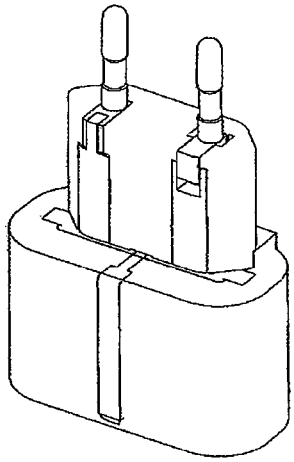
FIGURE 21

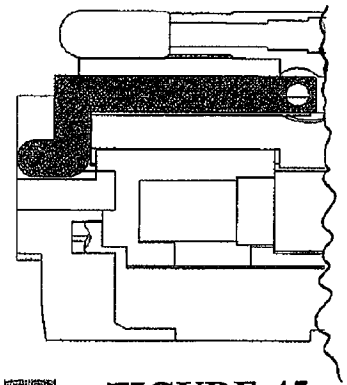
FIGURE 45
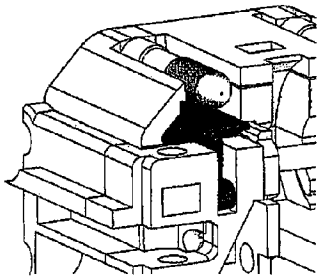
FIGURE 44
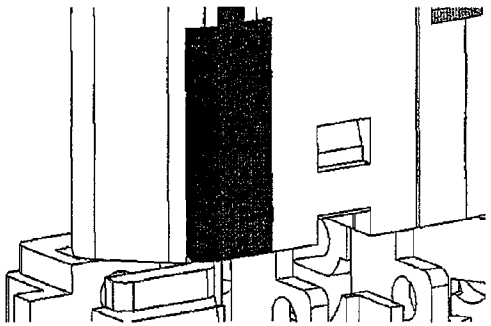
FIGURE 48
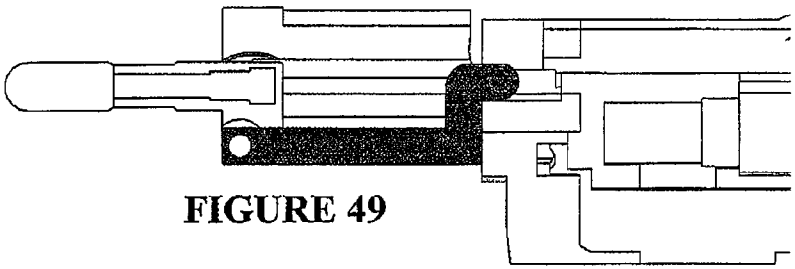
FIGURE 49
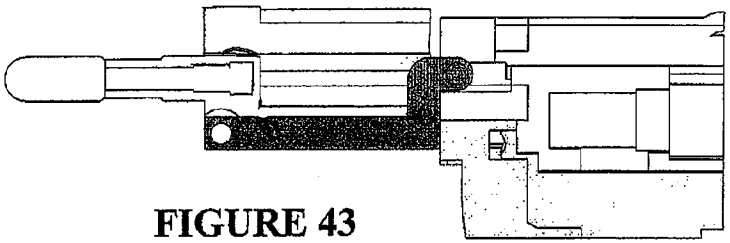
FIGURE 43
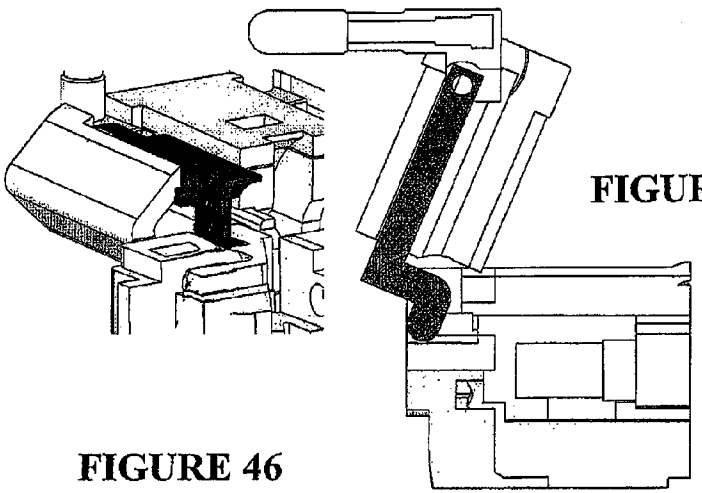
FIGURE 47
FIGURE 46

19
355
27
27A

ELECTRICAL PLUG/SOCKET ADAPTOR

CROSS-REFERENCE TO RELATED APPLICATION

This application is based on and claims priority to U.S. Provisional Patent Application Ser. No. 60/951,739, filed Jul. 25, 2007 entitled ELECTRICAL PLUG/SOCKET ADAPTER and to U.S. Provisional Patent Application Ser. No. 60/980,868 filed Oct. 18, 2007 entitled ELECTRICAL PLUG/SOCKET ADAPTER, the entire contents of which are hereby incorporated by reference herein.

BACKGROUND OF THE INVENTION

The present invention relates to an electrical plug/socket adaptor.

In particular though not solely the invention relates to an electrical plug/socket adaptor for use by travellers to allow for an adaptation of sockets found in various countries to occur so that plugs from other countries can make a connection with the socket. Further in particular, though not solely the present invention relates to an electrical plug/socket adaptor for adaptation of the sockets for use by domestic DC voltage devices.

Electrical plugs and their corresponding sockets differ by country in shape, size and configuration. The type of plug and socket used in each country for domestic power use is usually set by national standards, rules or legislation. Nearly every country around the world has been free to develop or adopt their own specific plug and socket design. For travelling this is a problem because travellers will take along devices that run on power and that utilize a plug that is designed to fit into sockets of their country of origin. This means that when a traveller wishes to use power in a country having sockets that do not correspond to the plug of the device for which they desire the power, a direct connection cannot be made. Adaptors to act intermediate of a plug and socket are known. Such adaptors may come in the form of a multi part adaptor where parts are removed and other parts are connected so as to reconfigure the adaptor for use in different countries. This requires for such multi parts to be retained together which can be problematic. If a part is lost then the adaptor may not be fully functional. Other adaptors exist that can cater for adaptation between different sockets and different plugs but where the size of the adaptor is undesirably large. For travellers, being able to travel with an adaptor that is of a compact size is desirable.

There are other adaptors available but that may not offer the versatility for providing adaptation between a substantial proportion of international socket designs and plug designs.

A significant challenge is to design an adaptor that is small and that contains:

a) the four plugs to connect to the four most common socket configurations being used in foreign countries, b) the possibility to plug in four corresponding plugs, c) to meet all safety standards for all plugs, and d) to provide a device that is generally safe.

This is desirable from a consumer's point of view as well as from a supply chain point of view. Manufacturers and/or distributors desire a reduction in stock numbers to reduce logistics complexities.

Also, to provide a small adaptor it must be at least big enough to meet the minimum surface requirements according to the various standards prescribing plug design. Ideally the adaptor at where the plug portion of the adaptor is to be provided should be sufficiently large to meet the safety standards but preferably be no larger than is necessary to allow full functionality of an adaptor.

The most common types of electrical plugs that are catered for by adaptors include:

a) the North American two-pin plug (comprising of flat parallel blades), b) the European two-pin plug (round pins with a plastic or rubber pin base, and also commonly known as the "Europlug"), c) the British three-pin plug comprising of rectangular blades, two of which are circuit blades and one of which may be an earth blade or dummy blade that also serves the purpose of actuating any socket connection restrictors upon the insertion of the plug into a corresponding socket, and d) the Australian two-pin plug (comprising of oblique blades).

Where reference herein is made to these types of plugs it is to be understood to mean plugs of this kind that are known and that include features as generally described above.

SUMMARY OF THE INVENTION

It is accordingly an object of the present invention to provide an electrical socket/plug adaptor that is of a compact size and that can allow for all safety standards regulations, rules or legislation prescribed for each of the plug configurations mentioned above that may be provided by the adaptor, to be met, and/or to at least provide the public with a useful choice.

Accordingly in a first aspect the present invention broadly consists in an electrical plug/socket adaptor for establishing an electrical connection between an electrical plug and an electrical socket, said adaptor comprising:

a housing with at least one electrical plug receiving zone to receive an electrical plug of a kind selected from at least one of a a) Europin electrical plug, b) British pin electrical plug, c) North America pin electrical plug, and d) Australia pin electrical plug, the adaptor configurable to itself be capable of being operatively plugged into an electrical socket of a kind selected from at least two of a:

i) Euro pin electrical socket, ii) British pin electrical socket, iii) North America pin electrical socket, and iv) Australia pin electrical socket.

Preferably adaptor pins to insert into a said electrical socket are carried by said housing in a movable manner relative thereto and that can be configured to an active condition to be presented from an adaptor pin presenting zone of said housing to allow their insertion into a said electrical socket.

Preferably said at least one plug receiving zone consists of a plurality of adaptor sockets to each receive a pin of a said electrical plug.

Preferably adaptor pins to insert into a said electrical socket are carried by said housing in a movable manner and can be configured to an active condition to be presented from an adaptor pin presenting zone of said housing to allow their insertion into the electrical socket and wherein said at least one electrical plug receiving zone consists of a plurality of adaptor sockets to each receive a pin of a said electrical plug.

Preferably an electrical connection is established between each adaptor socket and a corresponding adaptor pin when a said pin is configured in the active condition (and preferably not when in a stored condition).

Preferably an electrical connection exists between each adaptor socket and a corresponding adaptor pin.

Preferably said adaptor complies with British Standard "BS1363 Plug" at the adaptor pin presenting zone of the adaptor.

Preferably said adaptor complies with British Standard "BS1363 Plug" at the adaptor pin presenting zone of the adaptor.

Preferably said adaptor complies with British Standard "BS1363 (part 1:1995)".

Preferably for each British adaptor pin to be presented from the housing, a radial distance of at least 9.5 mm and no more than 15 mm (preferably 14 or 13 or 12, or 11 or 10 mm) exists to the most proximal periphery of the surface of the housing at where said adaptor pin presenting zone is provided, from where the British pin is presented in its active condition.

Preferably said housing includes at least one base member and at least one cover member movable between (1) a condition defining a pin enclosure within which at least two pairs of pins for engagement into two or more respective sockets of (i)-(iv) mentioned above are retained in a stored condition, and (2) an open condition exposing said at least two pins mentioned immediately above to allow for these to be digitally manipulated by a user to be moved from their stored condition to their active condition and visa versa.

Preferably adaptor pins to engage with all four sockets (i)-(iv) are provided by the adaptor.

Preferably pins (if provided) to engage into a Europin electrical socket are provided in a stored condition within said housing and under cover of a second cover member.

Preferably adaptor pins to engage with all four of said electrical sockets (i)-(iv) are provided by the adaptor and wherein said adaptor pins are rotatably movable between their active condition and stored condition each about a respective axis of rotation that are all proximate the adaptor pin presenting zone of the housing.

Preferably the housing includes a housing core and a housing peripheral region about said housing core, said housing core extending inwardly from the adaptor pin presenting zone and said housing peripheral region being about said housing core, wherein said adaptor pins are mounted for rotation relative to said housing to move between their locating, in the stored condition, predominantly within the housing peripheral region and their locating, in their active condition, extending solely from the core zone at the adaptor pin presenting zone (for all but preferably not the Europlug adaptor pins).

Preferably the housing peripheral region includes a surface as part of the adaptor pin presenting zone that is of a peripheral shape and configuration being at the minimum standards that define plug shape of the plug configurations that can be established by the adaptor pins (for all but the Europlug adaptor pins).

Preferably the housing when not in the closed condition, presents an interference member from the adaptor pin presenting zone that prevents full engagement of any of the adaptor pins (preferably other than those of the Europlug pins) from engaging into an electrical socket.

Preferably the at least one plug receiving zone can receive a plug for a DC voltage device, there being a transformer within said housing for transforming the AC voltage received by said adaptor from said socket to DC voltage.

Preferably the housing is a multipart housing comprising at least one cover part movable relative a base part.

Preferably said housing is configurable to different conditions to facilitate a reconfiguration of the adaptor plugs, including to a configuration where the housing encloses said adaptor pins.

Preferably the adaptor is an integral item not requiring the removal and/or attachment of parts to enable reconfiguration.

Preferably the adaptor is a self contained reconfigurable adaptor.

Preferably an auxiliary plug receiving housing can be engaged to part of said housing, said auxiliary plug receiving housing including a transformer to transform the AC voltage received from said electrical socket to DC voltage to be provided via a DC auxiliary plug receiving housing socket to a DC voltage device.

Preferably said auxiliary plug receiving housing can receive a USB plug.

Preferably said adaptor pin presenting zone is presented to face an opposite direction to the electrical plug receiving zone.

Preferably said adaptor pin presenting zone includes a planar surface.

In a second aspect the present invention consist in an electrical plug/socket adaptor for establishing an electrical connection between a electrical plug and an electrical socket, said adaptor comprising a housing defining two opposed end faces, a first end face and a second end face that is adapted to receive an electrical plug of a kind selected from at least one of a:

a) Euro pin plug, b) British pin plug, c) North America pin plug, and d) Australia pin plug, at least two pairs of adaptor pins capable of being plugged into an electrical socket of a kind selected from at least two of a:

i) Euro pin socket, ii) British pin socket, iii) North America pin socket, and iv) Australia pin socket, each pair of adaptor pins mounted in a pivotal manner relative to said housing to move between a stored condition wherein said pins are retained within the housing and an active condition wherein a pair of said adaptor pins extends from said housing at said first end face, presented for engagement with a complementary electrical socket.

Preferably said first end face includes a perimeter zone and an inner zone surrounded by said perimeter zone, wherein each said pair of adaptor pins (other than those to engage with the Euro pin socket if provided) when positioned in the active condition, extends from said first end face only at said inner zone, said inner zone not being closer to the outer perimeter of the perimeter zone than either (i) 9 mm or (ii) than is permissible by at least one applicable standard.

Preferably said standard is BS1363 (part 1:1995)".

Preferably each said pair of adaptor pins (other than those to engage with a Euro pin socket, if provided) in said stored condition are retained within said housing between said first end face and second end face, predominantly beneath said perimeter zone of said first end face.

Preferably said housing is a multi part housing, including a base member and at least one cover member, said at least one cover member movable relative to said base member between at least two positions, (i) a first position to cover the pair(s) of adaptor pins (preferably other than those to engage with a Euro pin socket) when these are in the stored condition, to prevent movement of these pairs of adaptor pin between the stored condition and active condition, and (ii) a second position exposing said pairs of adaptor pins (preferably other than those to engage with a Euro pin socket) to, when in the stored condition, allow their movement to the active condition and visa versa.

Preferably one pair of adaptor pins is capable of being plugged into a Euro pin socket and at least one other pair of adaptor pins is capable of being plugged into an electrical socket of a kind selected from one of a:

a) British pin socket, b) North America pin socket, and c) Australia pin socket, wherein said pair of pins capable of being plugged into a Euro pin socket is mounted from said housing by an articulation member intermediate of said housing and said pair of adaptor pins capable of being plugged into a Euro pin socket.

Preferably the articulation member includes a parallelogram mechanism arrangement.

Preferably said parallelogram mechanism arrangement includes at least two arms, each defining at or towards their distal ends an axis of rotation that is parallel to that of the other arms.

Preferably there are three arms.

Preferably said second end face includes a plurality of adaptor sockets to receive a pin of various electrical plugs.

Preferably said second end face includes one adaptor sockets to receive a pin of various electrical plugs.

Preferably said housing includes electrical link bars to provide and electrical connection between said adaptor pins and adaptor sockets, said link bars and said adaptor pins configured to establish said electrical connection when said adaptor pins are moved to their active condition and wherein the electrical connection does not exist when the adaptor pins are in their stored condition.

Preferably the housing includes a housing core and a housing peripheral region about said housing core, said housing core extending inwardly from the adaptor pin presenting zone and said housing peripheral region being about said housing core, wherein said adaptor pins are mounted for rotation relative to said housing to move between their location, in the stored condition, predominantly within the housing peripheral region and their location, in their active condition, extending solely from the core zone at the first face end (for all but preferably not the Europlug adaptor pins).

Preferably the housing peripheral region has a peripheral shape and configuration to be at the minimum standards that define plug shape of the plug configurations that can be established by the adaptor pins (for all but the Europlug adaptor pins).

Preferably the housing when not in the closed condition, presents an interference member from the adaptor pin presenting zone that prevents full engagement of any of the adaptor pins (preferably other than those of the Europlug pins) from engaging into an electrical socket.

Preferably the adaptor is an integral item not requiring the removal and/or attachment of parts to enable reconfiguration.

Preferably the adaptor is a self contained reconfigurable adaptor.

In a further aspect the present invention broadly consists in an adaptor plug/socket for establishing an electrical connection between an electrical plug and an electrical socket, said adaptor configurable to itself be capable of being plugged into an electrical socket of a kind providing AC voltage and that is selected from at least two of a:

a) Euro pin socket, b) British pin socket, c) North America pin socket, and d) Australia pin socket, the housing also including a zone to receive said electrical plug, the electrical plug being for a DC voltage device, there being a transformer within said housing for transforming the AC voltage to DC voltage.

In still a further aspect the present invention consists in an electrical plug/socket adaptor for establishing an electrical connection between a electrical plug of one configuration and an electrical socket of a different configuration, the electrical plug configuration being of at least one of a Euro pin plug configuration, British pin plug configuration, North America pin plug configuration and Australia pin plug configuration, and the socket configuration being at least two of a Euro pin socket configuration, British pin socket configuration, North America pin plug configuration and Australia pin plug configuration, the adaptor comprising:

a) a housing that defines two opposed planar adaptor end faces, b) a plurality of pairs of pins mounted to said housing in a rotatable manner between a stored condition to be located within said housing and an active condition to be presented from said housing at one of the end faces, the axes of rotation of said pins lying in a plane or planes that are parallel to each other and parallel to the end faces of said housing, the housing being of a distance between said end faces to just accommodate the pins in their stored condition.

Preferably the housing includes a housing core and a housing peripheral region about said housing core, said housing core extending inwardly from the first end face and said housing peripheral region being about said housing core, wherein said adaptor pins are mounted for rotation relative to said housing to move between their locating, in the stored condition, predominantly within the housing peripheral region and their locating, in their active condition, extending solely from the core zone at the adaptor pin presenting zone (for all but preferably not the Europlug adaptor pins).

Preferably the periphery of housing peripheral region is of a peripheral shape and configuration to be at the minimum standards that define plug shape of the plug configurations that can be established by the adaptor pins (for all but the Europlug adaptor pins).

In a further aspect the present invention broadly consists in an electrical plug/socket adaptor for establishing an electrical connection between a electrical plug and an electrical socket, said adaptor comprising:

a housing with at least one electrical plug receiving zone to receive an electrical plug of a kind selected from at least one of a 1. Euro pin electrical plug,
2. British pin electrical plug,
3. North America pin electrical plug, and
4. Australia pin electrical plug, the adaptor further including a Euro pin plug arrangement capable of being operatively plugged into a Euro pin electrical socket, said plug arrangement being movable relative to said housing from a stored condition wherein it is proximal more the housing and an erected condition where it is presented less proximal said housing.

Preferably said plug arrangement includes two euro pin electrical terminals that are pivotally engaged to an intermediate member that is located intermediate of said electrical terminals and said housing, said intermediate member pivotally engaged to said housing on an axis parallel to the axis of pivot of said electrical terminals.

Preferably for a first of said electrical terminals there is a link bar ("first link bar") that extends between said housing and said first electrical terminal and engages to (i) said electrical terminal at a lever thereof that can actuate pivotal movement of said first electrical terminal relative to said intermediate member, and (ii) said housing in a pivotal manner, and for a second of said electrical terminals there is a link bar ("second link bar") that extends between said housing and said electrical terminal and engages to (i) said second electrical terminal at a lever thereof that can actuate pivotal movement of said second electrical terminal relative to said intermediate member, and (ii) said housing in a pivotal manner.

Preferably said first link bar has both its pivot axes parallel to the two pivot axes of the second link bar.

Preferably the pivot axis of the first link bar with the first electrical terminal is parallel to but not coaxial with the pivot axis of the second link bar with the second electrical terminal.

Preferably the pivot axis of the first link bar with the housing is parallel to but not coaxial with the pivot axis of the second link bar with the housing.

Preferably the pivot axis of the intermediate member with said housing is parallel to but not coaxial the pivot axis of the first link bar with the housing nor the pivot axis of the second link bar with the housing.

Preferably the pivot axis of the intermediate member with each of said electrical terminals is parallel and coaxial, this pivot axis in parallel but not coaxial with the pivot axis of the first link bar with the first electrical terminal nor with the pivot axis of the second link bar with the second electrical terminal.

Preferably at one face of the adaptor there is provided a region for receiving all of the electrical plugs said region including two apertures that are mirror images of each other, each aperture being rectangular in form having a perimeter to receive a British pin of a British pin plug, save for an extension on said perimeter at a corner of said rectangle to also allow the receipt of an Australian pin of an Australian plug and save for an extension on said perimeter to allow the receipt of a North American pin of a North American plug.

Preferably the adaptor includes a sliding safety cover that includes openings to allow insertion of electrical pins of an electrical plug to be plugged into the adaptor, said cover movable between a first position where it presents said openings in register with openings of said housing that can receive said electrical pins and a second position where it presents said openings out of register with said openings of said housing to prevent the access of electrical pins into said housing.

Preferably said cover when in the out of register position covers the openings of said housing are completely covered by said cover.

Preferably said cover is biased to the second position.

Preferably said first cover member is associated with an interference member that is movably engaged to said housing, said interference member movable by said first cover member between (ii) a stored condition corresponding to the first cover member being in it first position and where said interference member does not protect from said first end face, and (ii) an active condition corresponding to the first cover member not being in its first position and where said interference member does project from said first face to interfere with any attempt to insert the adaptor into an electrical socket whilst the elements of the adaptor otherwise covered by the first cover member may be exposed.

Preferably said interference member is pivotally mounted to said housing.

Preferably said interference member is pivotally engaged to said first cover member.

Preferably the pivot axis of said first cover member with said interference member is parallel to but not coaxial with the pivot axis of said interference member with said housing.

The invention may also broadly consists in an adaptor as herein described and as shown with reference to any one of the accompanying drawings.

The invention may also consist in an adaptor as shown in the accompanying drawings.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

This invention may also be said broadly to consist in the parts, elements and features referred to or indicated in the specification of the application, individually or collectively, and any or all combinations of any two or more of said parts, elements and features, and where specific integers are mentioned herein which have known equivalents in the art to which this invention relates, such known equivalents are deemed to be incorporated herein as if individually set forth.

BRIEF DESCRIPTION OF THE DRAWINGS

Preferred forms of the present invention will now be described with preference to the accompanying drawings in which.

FIGS. 43-49 illustrate parts of the adaptor and the Europlug pins and various positions thereof.

DESCRIPTION OF PREFERRED EMBODIMENTS

Figure 1:
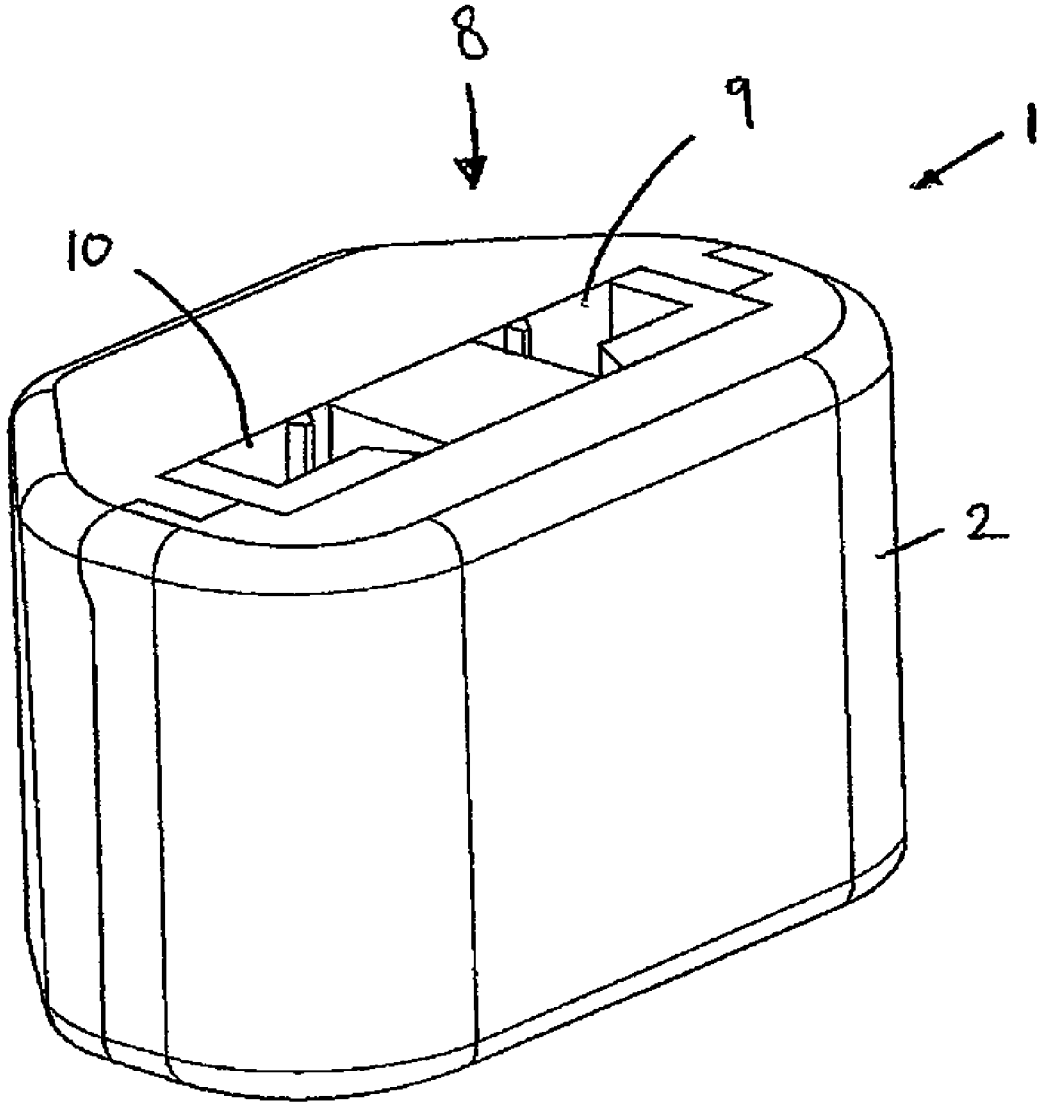
FIG. 1 is a perspective view of an adaptor seen looking towards the second face end at where a plug can engage into the adaptor sockets.
Figure 2:
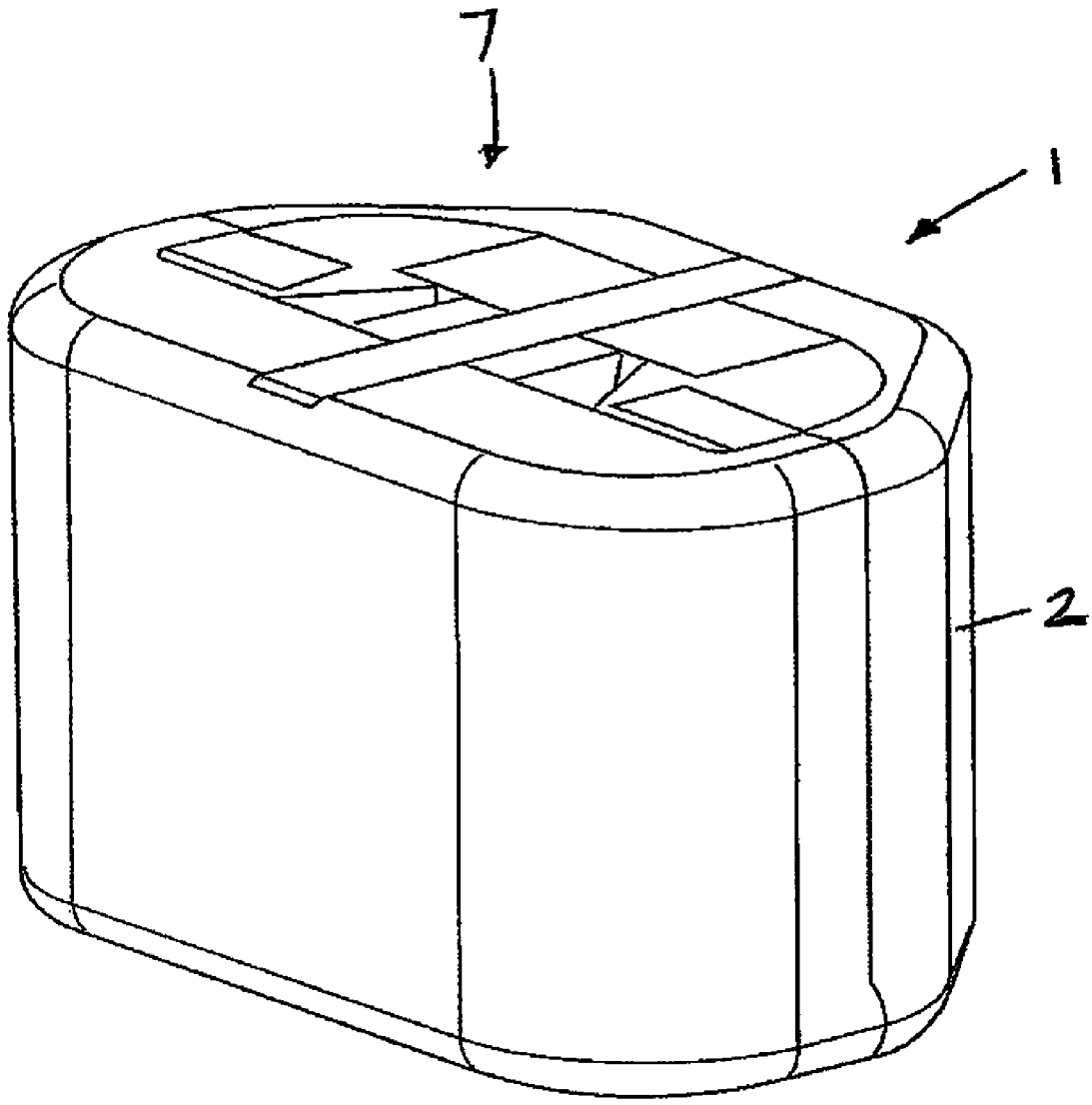
FIG. 2 is a perspective view of the adaptor looking at the first face end (facing opposite to the second face end) at where pairs of adaptors pins can be presented for engagement with a socket.
Figure 2H:
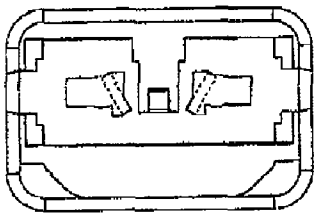
FIGS. 2*e*-2*h* are plan views of the adaptors of FIGS. 2*a*-2*d* respectively, each showing in phantom the associated electrical terminals of the electrical plugs shown with reference to FIGS. 2*a*-2*d*.
Figure 2D:
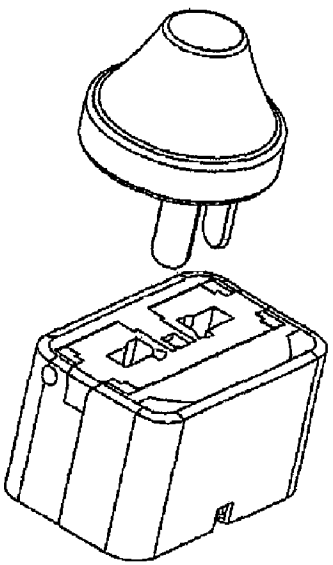
FIG. 2*d* is a perspective view of an adaptor and an electrical plug for engagement with the adaptor wherein the electrical plug is an Australian two-pin plug.
Figure 2G:
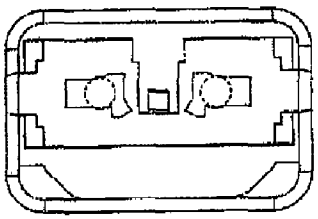
Figure 2C:
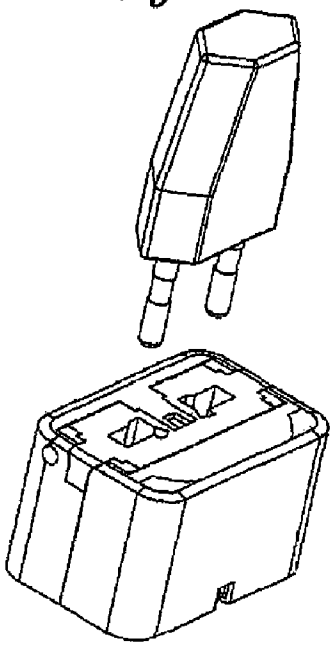
FIG. 2*c* is a perspective view of an adaptor and an electrical plug for engagement with the adaptor wherein the electrical plug is a Euro-pin plug.
Figure 2F:
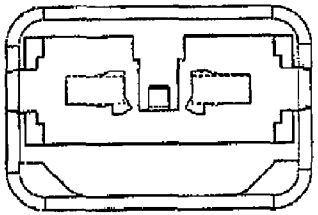
Figure 2B:
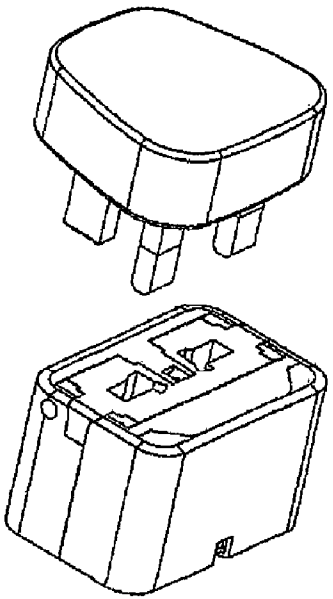
FIG. 2*b* is a perspective view of an adaptor and an electrical plug for engagement with the adaptor wherein the electrical plug is a British three-pin plug.
Figure 2E:
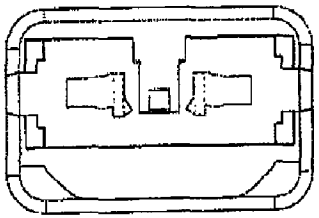
Figure 2A:
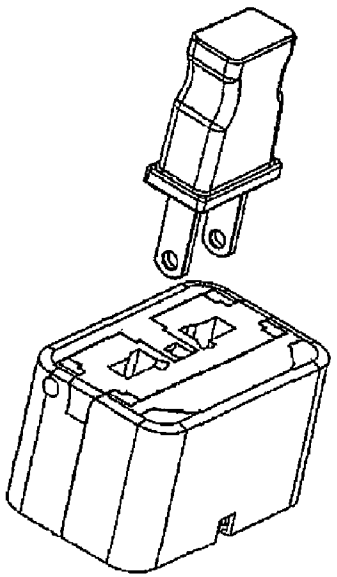
FIG. 2*a* is a perspective view of an adaptor and an electrical plug for engagement with the adaptor wherein the electrical plug is a North American plug.

With reference to FIGS. 1 and 2 there is shown the adaptor 1 of the present invention. The adaptor 1 is of a kind that may also be known as a universal adaptor or multi adaptor or travel adaptor or similar. For convenience it will be referred to as an adaptor, electrical adaptor or electrical plug/socket adaptor in various parts of this specification.

The adaptor 1 consists of a housing that may itself consist of multiple parts movable relative to each other. This is for example shown with reference to FIG. 3 where the housing 2 consists of a first cover member 3, a second cover member 4 and a base part 6 relative to which for example the cover members 3 and 4 may pivotally rotate such as about a pivot axis XX. Essentially the base part 6 of the housing defines the supporting structure from which various components of the adaptor directly or indirectly depend.

With reference to FIG. 2, the adaptor includes a first end face 7. The first end face is the face of the adaptor from which the adaptor pins may extend.

With reference to FIG. 1, the adaptor also includes a second end face 8 that preferably projects in an opposite direction to the first end face 7. The second end face 8 is a region of the adaptor at where an electrical plug can be inserted into the adaptor 1. The housing 2 defines adaptor sockets 9, 10 at the second end face 8 into which the pins or blades of an electrical plug can be inserted. The adaptor sockets 9, 10 include electrical terminals for establishing an electrical connection between the electrical plug that is inserted into the adaptor, and the adaptor itself.

The adaptor sockets 9, 10 are of a configuration to be able to receive the pins/blades of electrical of at least two different configurations that may be selected from the following list:

a) the North American two-pin plug (comprising of flat parallel blades), b) the European two-pin plug (round pins with a plastic or rubber pin base, and also commonly known as the "Europlug"), c) the British three-pin plug comprising of rectangular blades, two of which are circuit blades and one of which may be an earth blade or dummy blade that also serves the purpose of actuating any socket connection restrictors upon the insertion of the plug into a corresponding socket, and d) the Australian two-pin plug (comprising of oblique blades).

Whilst some electrical plugs may include an earth pin, the adaptor sockets of the adaptors may only receive circuit pins of an electrical plug. Any earth pin that may be presented by an electrical plug would preferably not engage with parts of the adaptor 1 but may merely sit outside of the housing of the adaptor in a free and unplugged condition. The body of the housing and second end face 8 of the adaptor are of a size to allow for such non-circuit pins of an electrical plug to be positioned accordingly. Usually such non-circuit pins of an electrical plug are the earth pin or a dummy pin that takes into account the national standards for electrical plugs/sockets.

Figure 3:
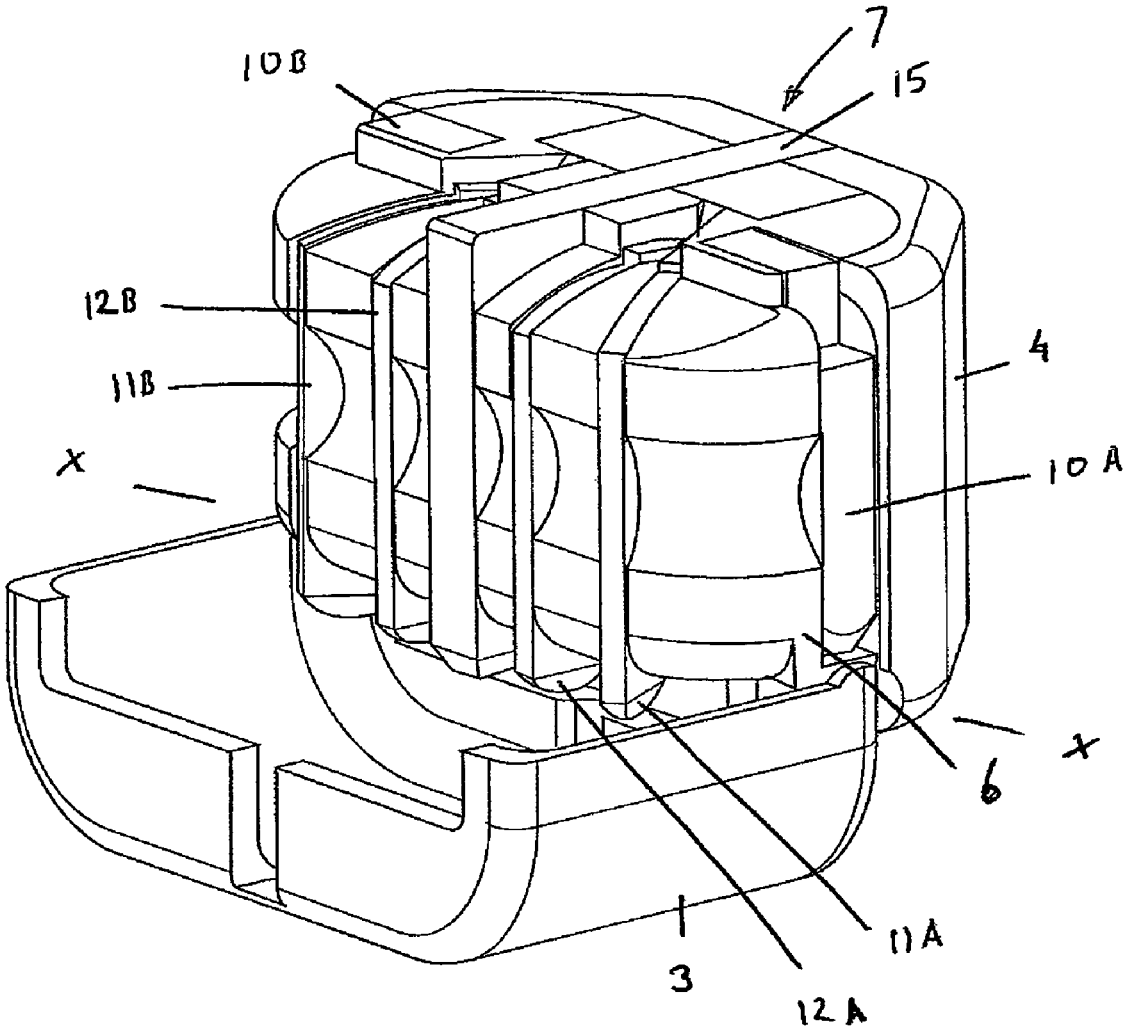
FIG. 3 is a perspective view of an adaptor with part of the housing moved relative to other parts of the housing to expose three pairs of adaptor pins.

Retained within the housing when in a stored condition, are a plurality of adaptor pins. With reference to FIG. 3, there are shown three pairs of pins to be retained under cover of the first cover member 3. A first pair consists of British pins 10A and 10B, a second pair are Australian pins 11A and 11B and a third pair are US pins 12A and 12B.

The housing of the adaptor may also house a Europin pair to which reference hereinafter will be made.

Figure 4:
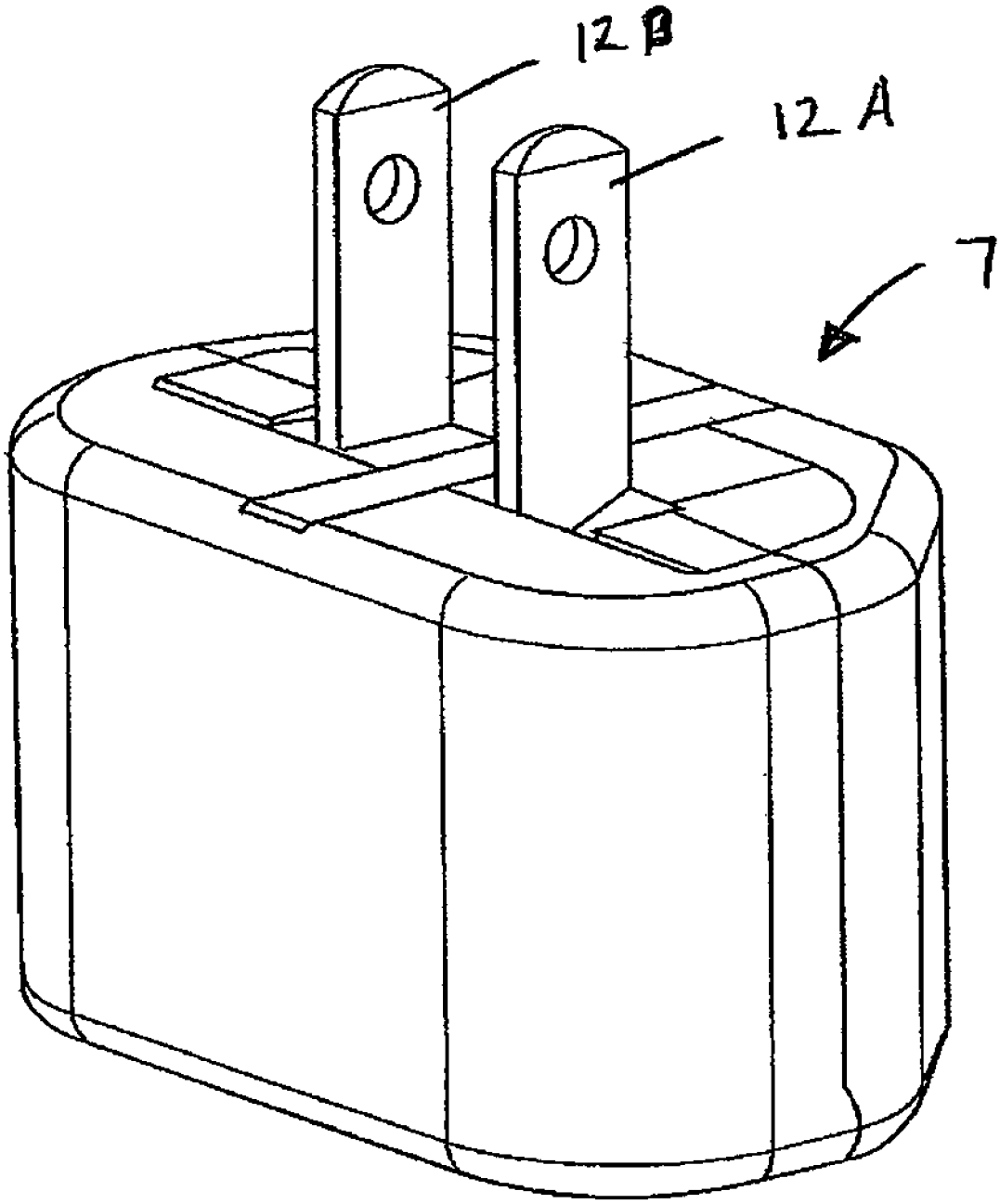
FIG. 4 is a perspective view of an adaptor where a pair of adaptor pins has been moved from their stored condition as shown in FIG. 3, to their active condition.

Pin pairs are preferably mounted to the base part 6 of the housing 2 in a pivotal manner. Each pin can be rotated from its stored condition as shown in FIG. 3, to an active condition as shown for example in FIG. 4 with reference to the US pins 12A/12B. In the active condition a pin pair present themselves through an appropriately shaped aperture of the first end face 7 and preferably in a direction perpendicular from the first end face 7. For each pin pair, the first end face includes an aperture formed through the housing to allow for the pin pairs to extend from the first end face 7. Movement between the active and stored conditions of each of the pins can be achieved once the cover member 3 of the housing 2 opens the housing enclosure as for example shown in FIG. 3. To meet safety requirements the Europins should be presented from the intermediate member 19. This intermediate member must have an end face that measures 13.7 mm across and is 35.3 mm in length. The intermediate member 19 must not exceed this dimension within 18 mm from the end face 26. Therefore it is preferred that the Europin plug is incorporated with the adaptor in a manner that is different to that of the other pins (eg without the intermediate member 19 being present).

Figure 5:
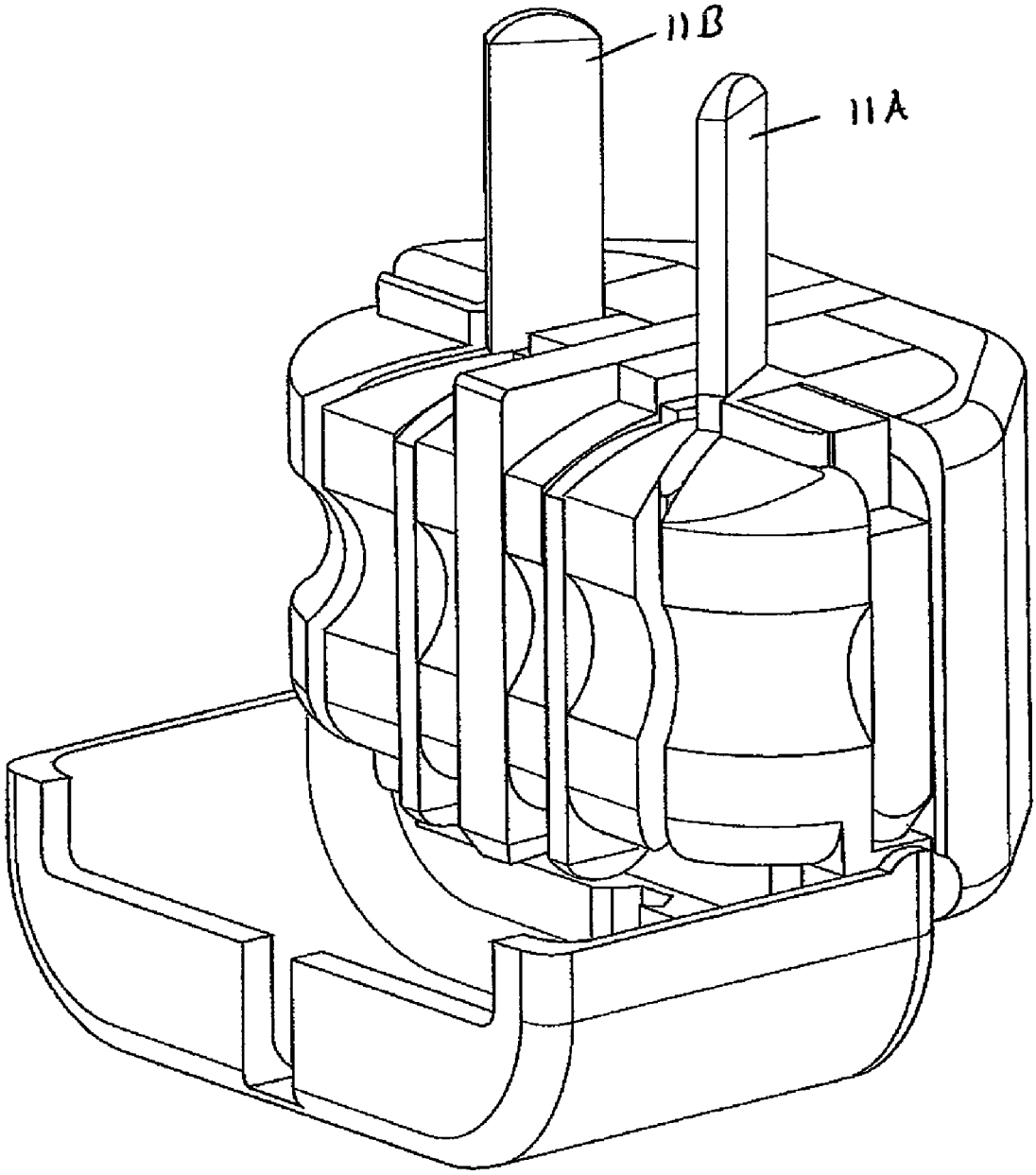
FIG. 5 illustrates a perspective view of the adaptor where part of the housing has been moved to open the enclosure at where some of the adaptor pins are located in their stored condition and wherein a pair of adaptor pins has been moved to their active condition.
Figure 25:
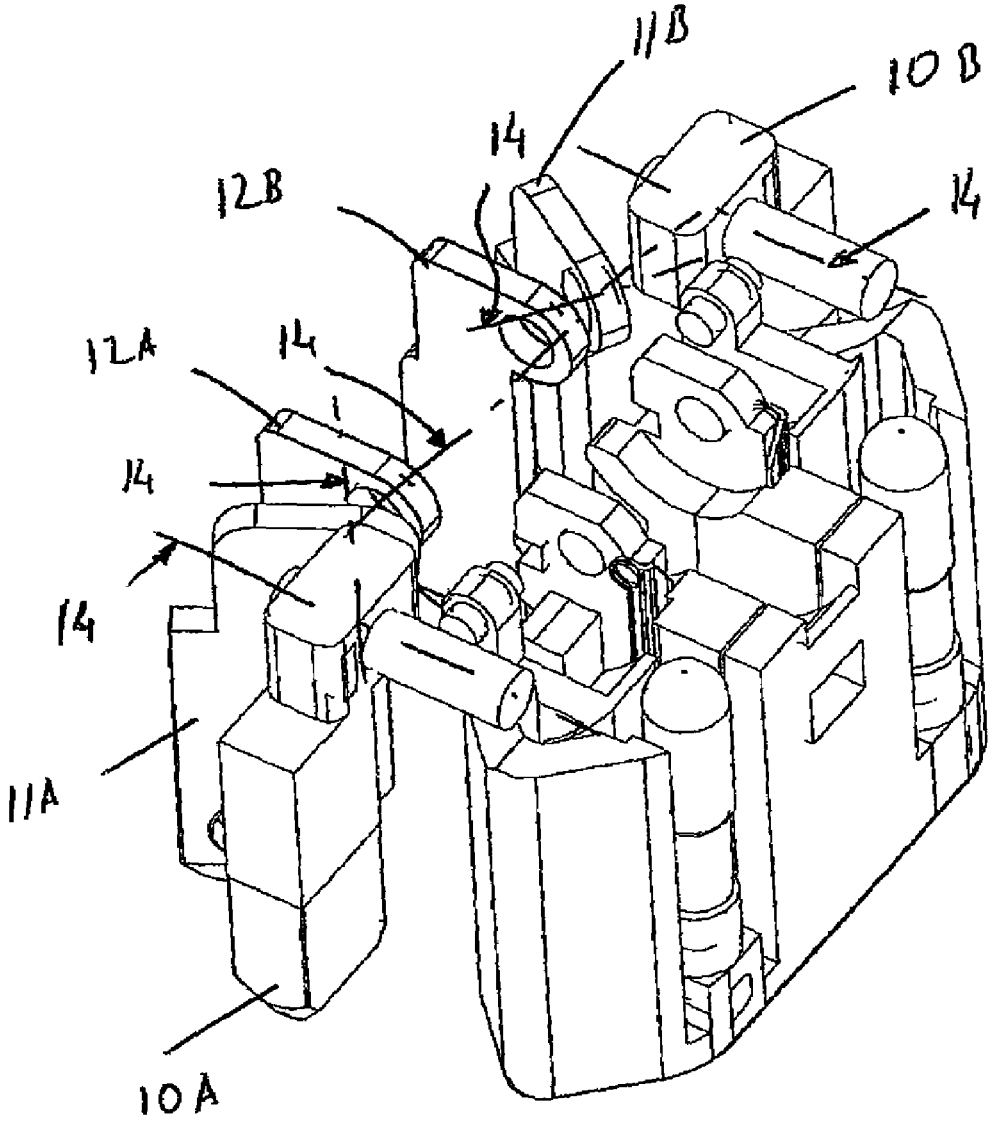
FIG. 25 illustrates components of an adaptor, including the adaptor pins in their stored configuration.

FIG. 25 illustrates pivot axes 14 for each of the pins. Each pivot axis may be defined by an axel of the base member 6. The axels and hence the axis that they define, are preferably orientated so that the pins can rotate between an appropriately configured active condition and stored condition. They are orientated so that in their stored condition all of the pins are retained in a compact space. It can be seen that each axis of rotation of the Australian pins are oblique to each other and to the axis of the US pins and the British pins so that the Australian pins when in their active condition are appropriately oblique to each other as shown in FIG. 5. The axes preferably all lie in one plane. This plane is preferably parallel to the first end face 7.

Figure 6:
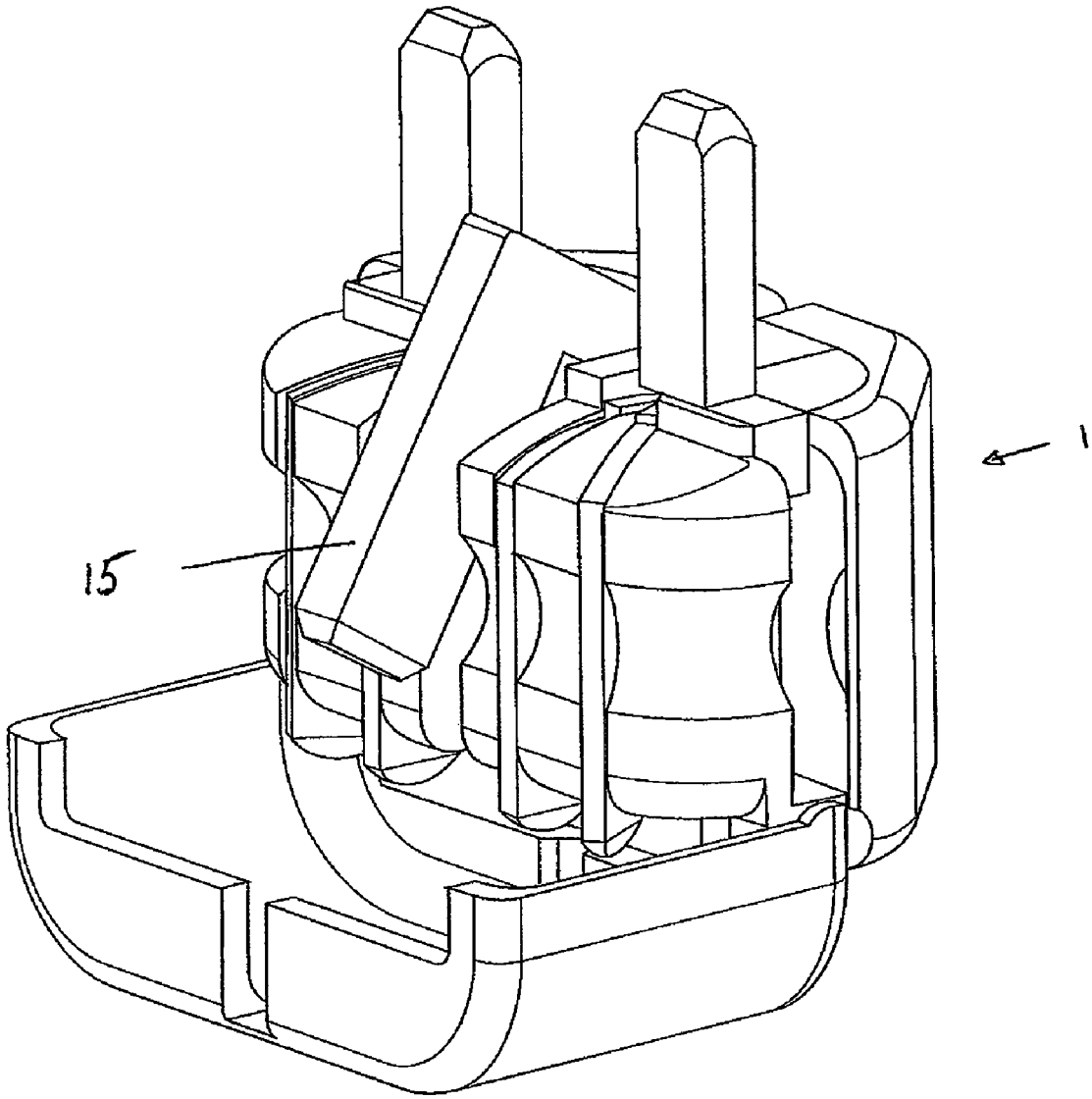
FIG. 6 is a perspective view similar to that of FIG. 5 but wherein two rectangular blades of the British three-pin plug have been moved to an active condition and wherein a third rectangular blade is intermediate of its stored condition and active condition.
Figure 7:
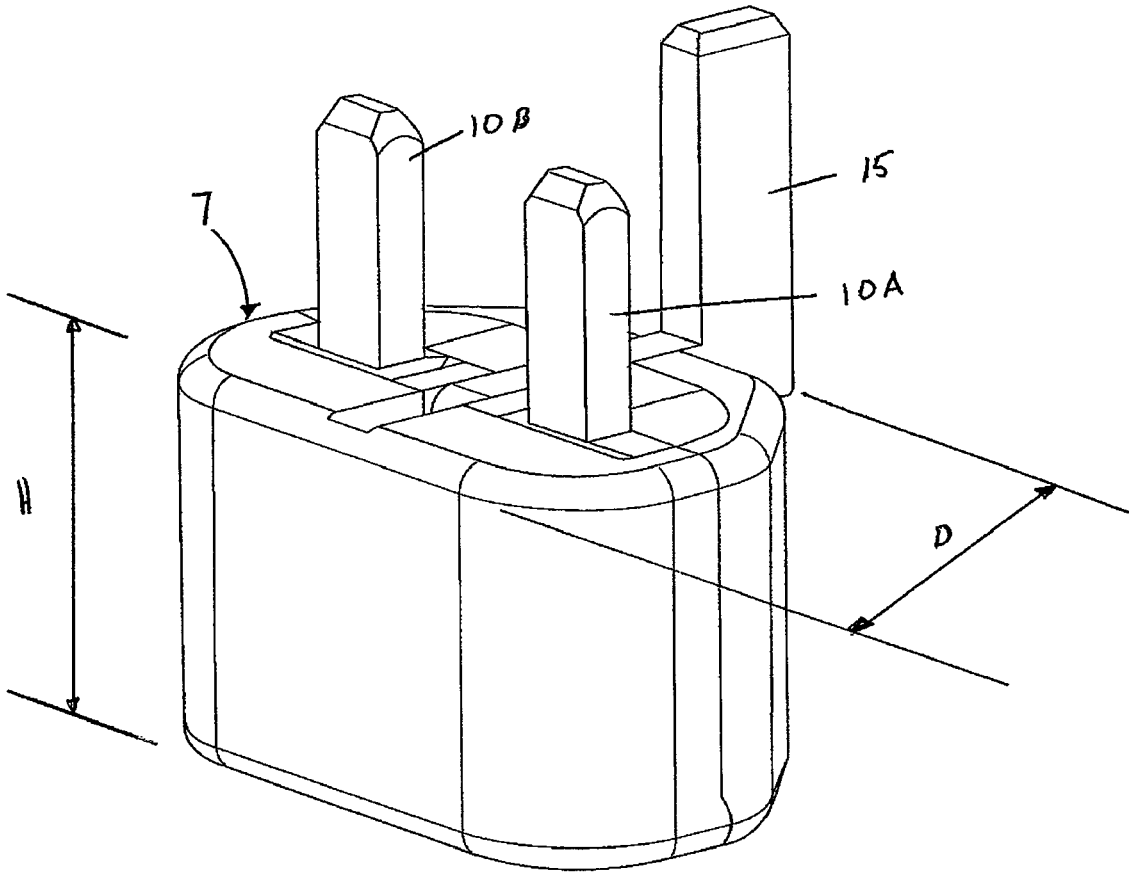
FIG. 7 is a perspective view of the adaptor where the adaptor presents adaptor pins of a British three-pin plug configuration.
Figure 8A:
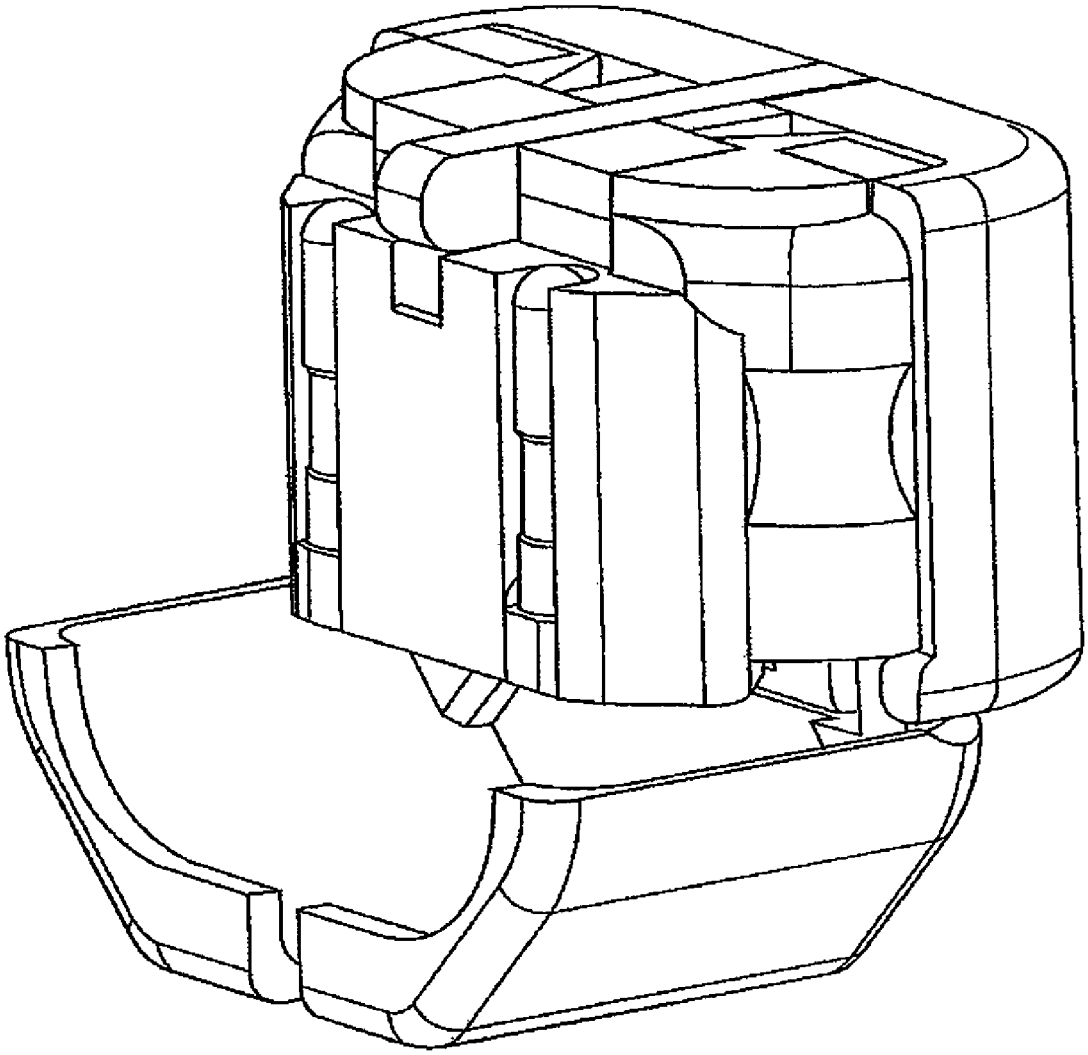
FIG. 8*a* illustrates a perspective view of the adaptor wherein a different part of the housing has been moved relative to other parts of the housing to expose a further pair of adaptor pins, namely to define the European two-pin plug.
Figure 8B:
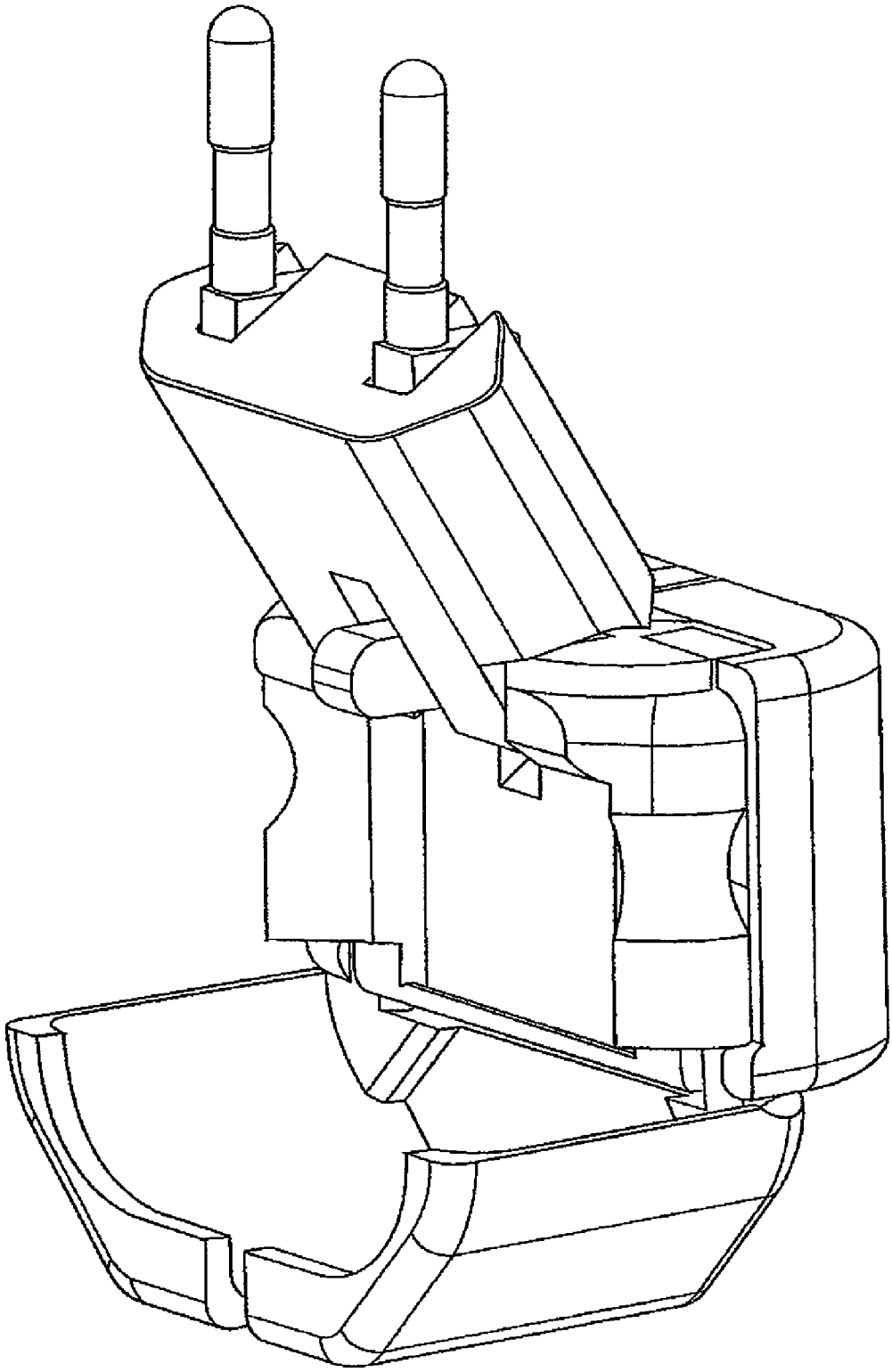
FIG. 8*b* illustrates a transition of the adaptor pins of the European two-pin plug in transition from its stored condition to an active condition.
Figure 26:
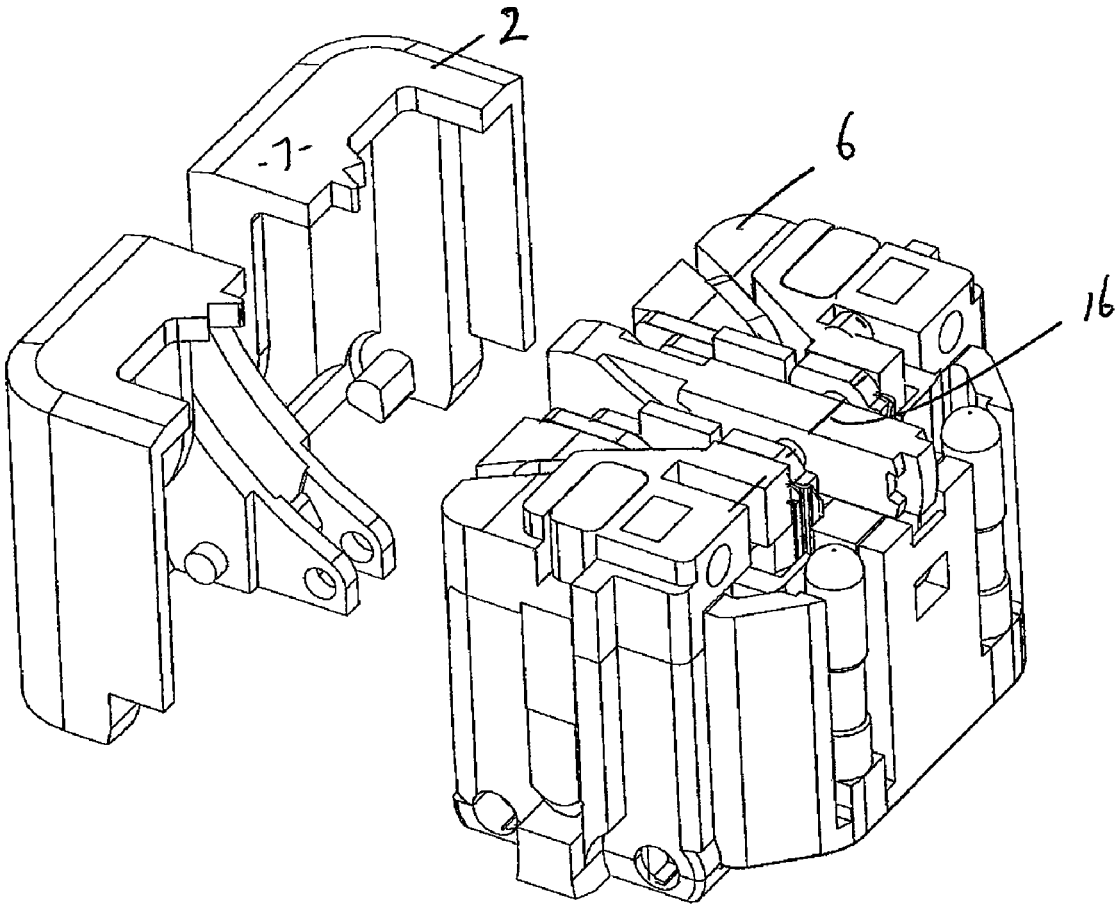
FIG. 26 is a perspective partially exploded view of components of the adaptor wherein the adaptor pins are in their stored condition.
Figure 27:
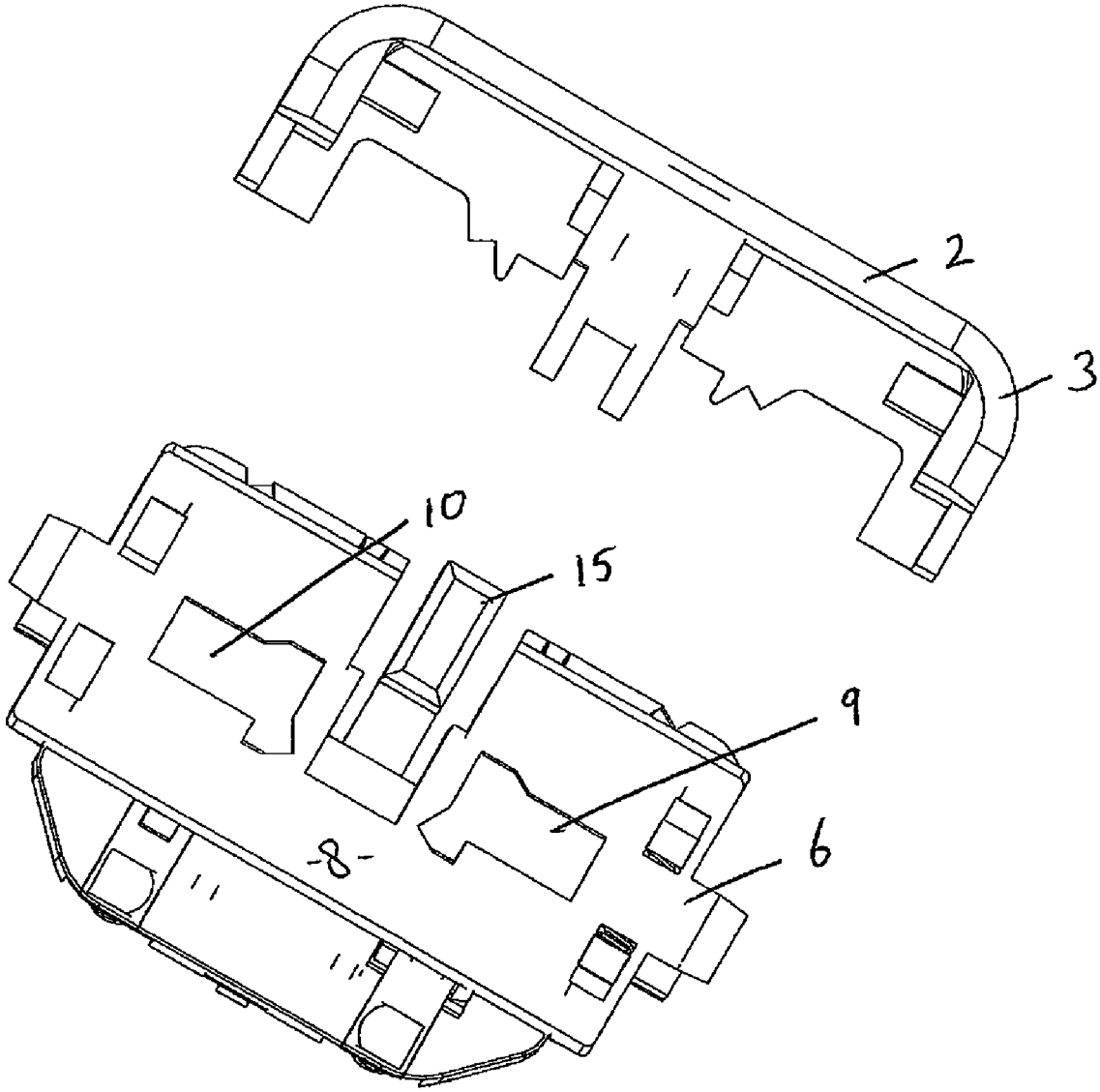
FIG. 27 is a plan view of FIG. 26.
Figure 28:
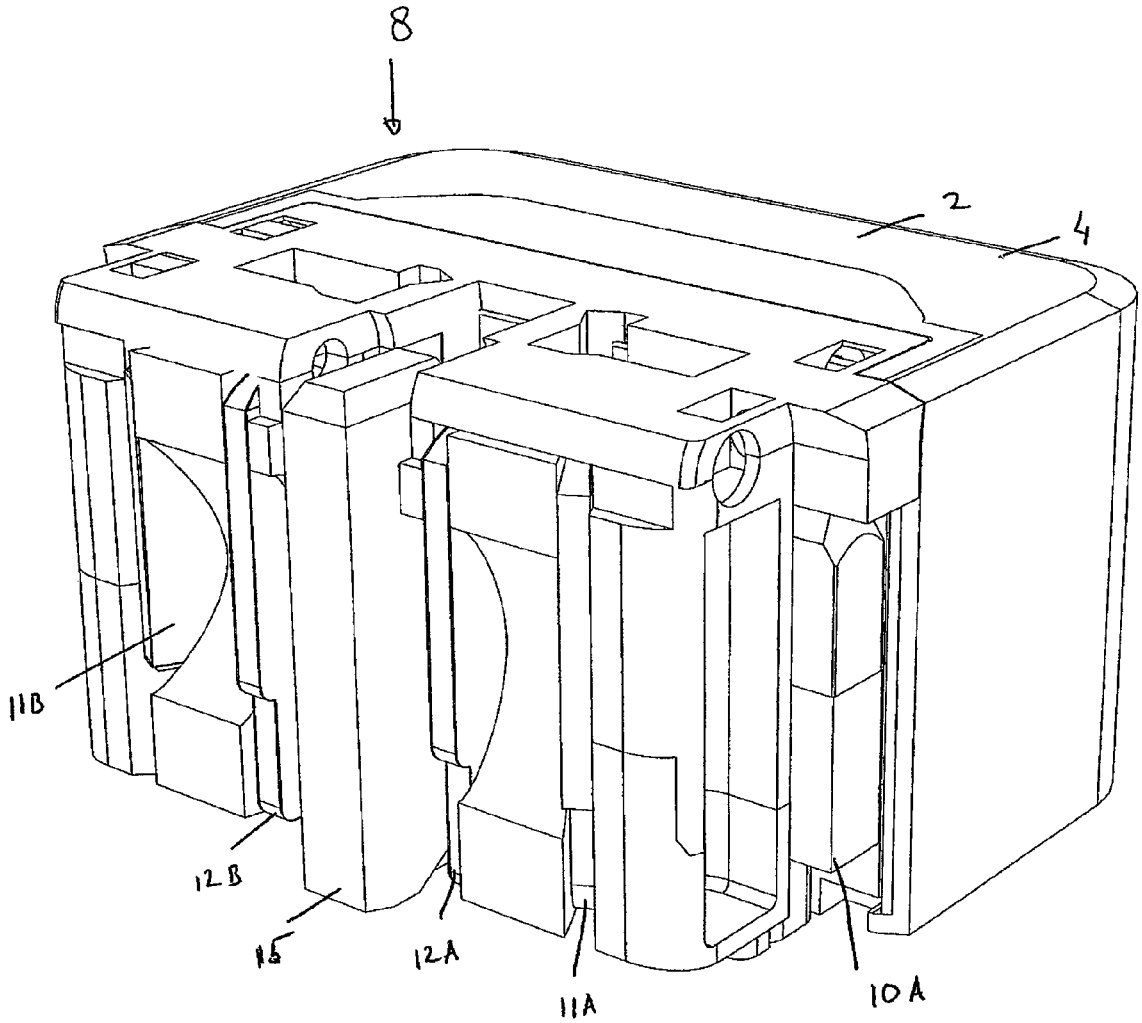
FIG. 28 is a perspective view of part of the components of the adaptor.
Figure 29:
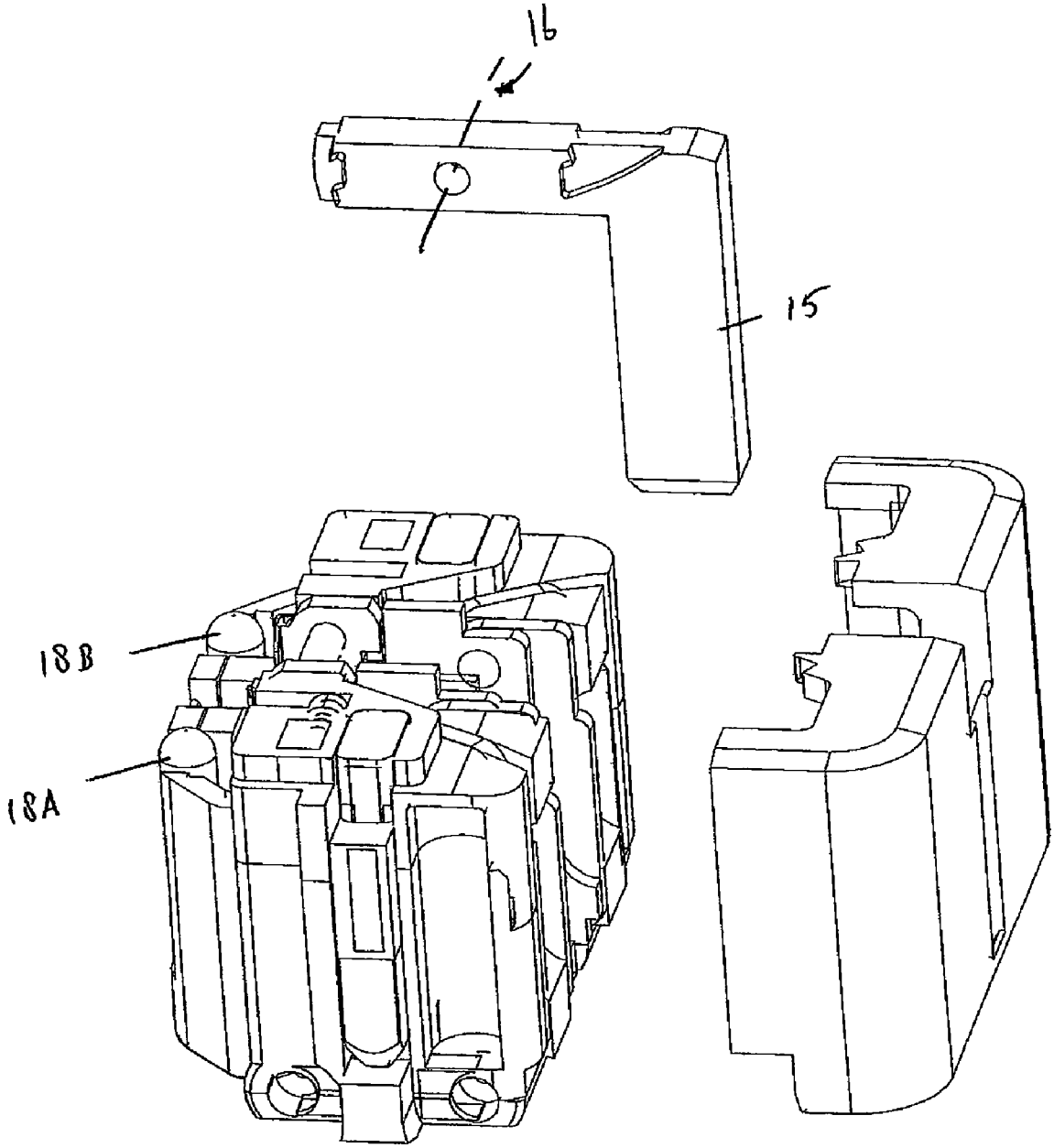
FIG. 29 is a perspective and partially exploded view of certain parts of the adaptor of the present invention.
Figure 30:
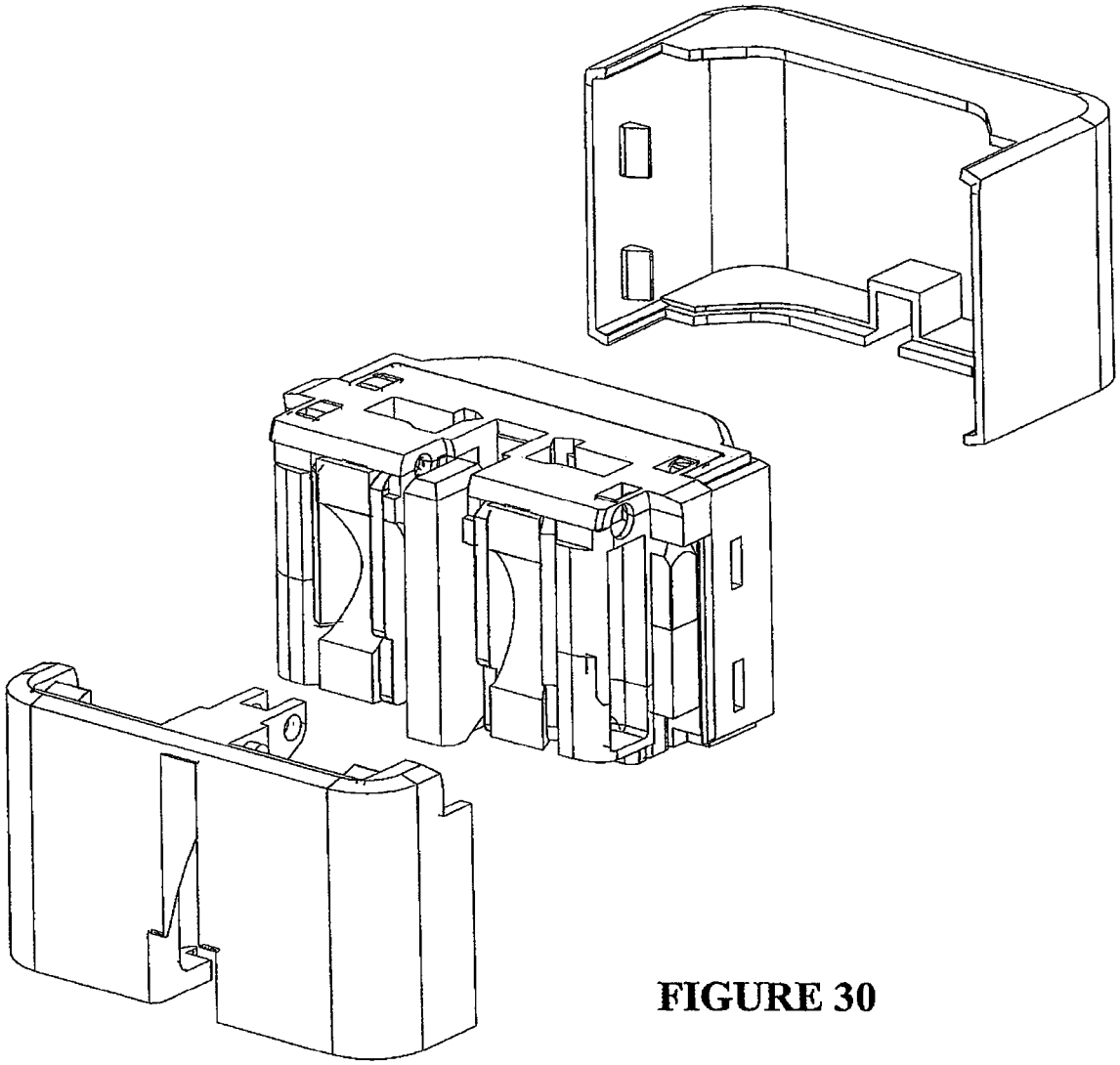
FIG. 30 is a perspective and partially exploded view of the adaptor of the present invention.
Figure 31:
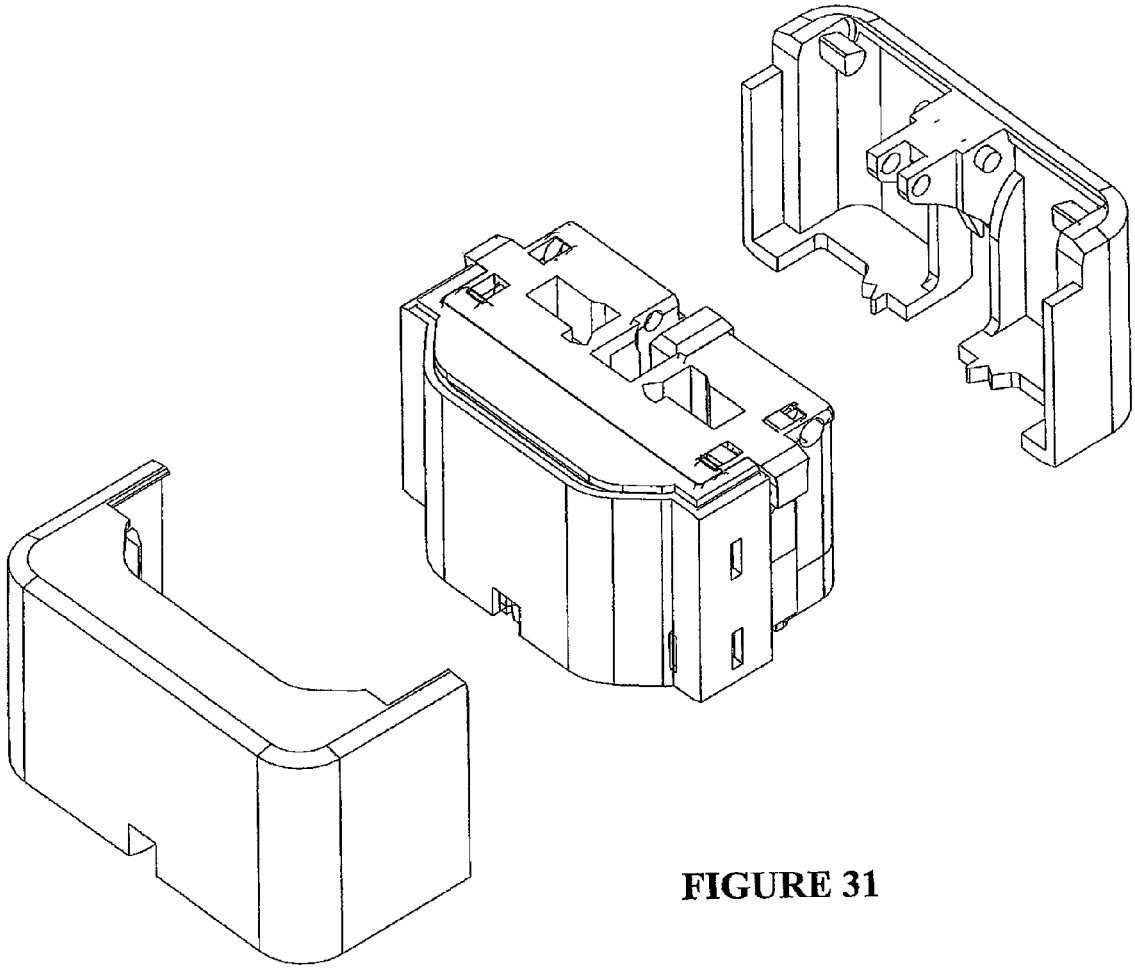
FIG. 31 is a perspective view from a different direction to that of FIG. 30.
Figure 32:
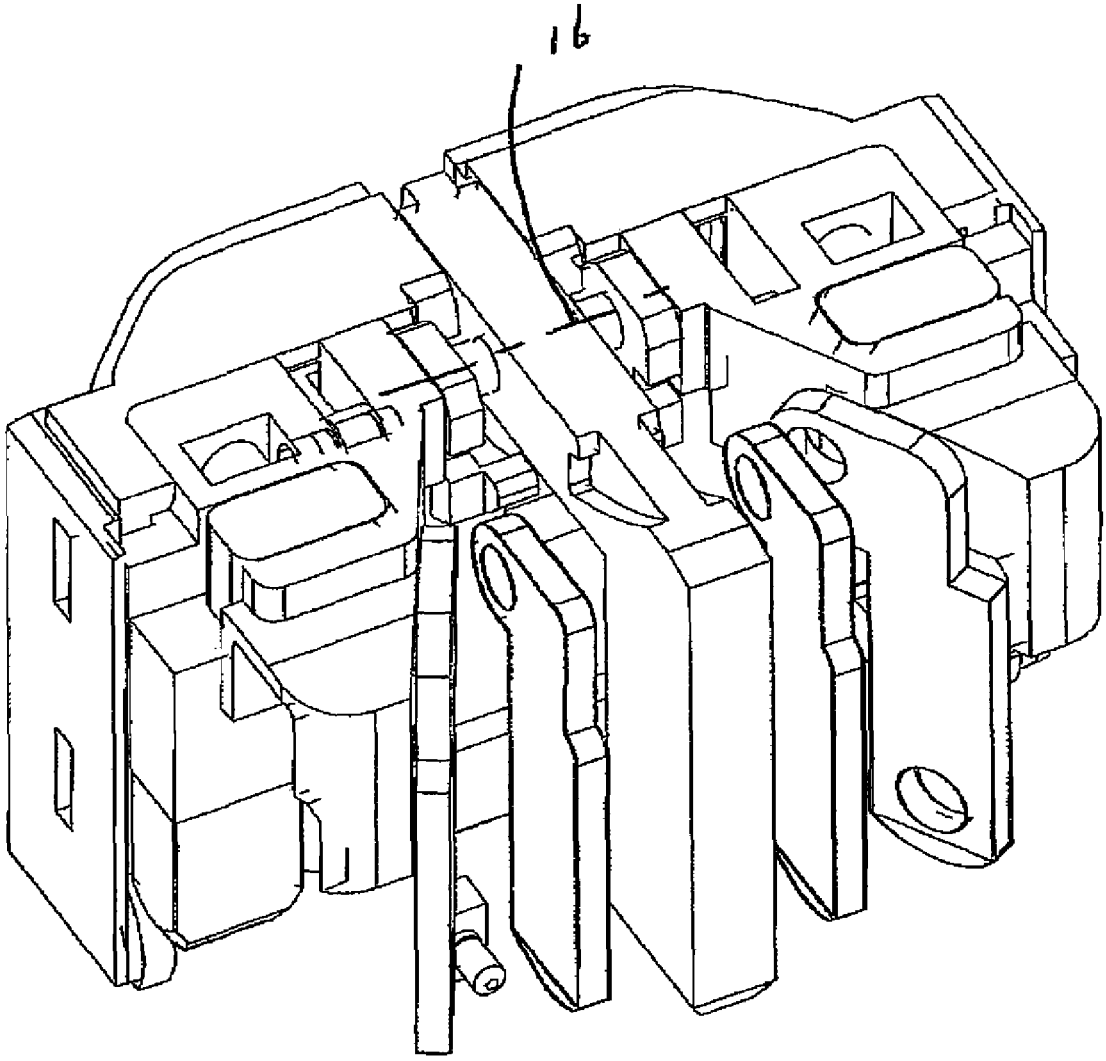
FIG. 32 is a perspective view of some of the components of the adaptor.
Figure 33:
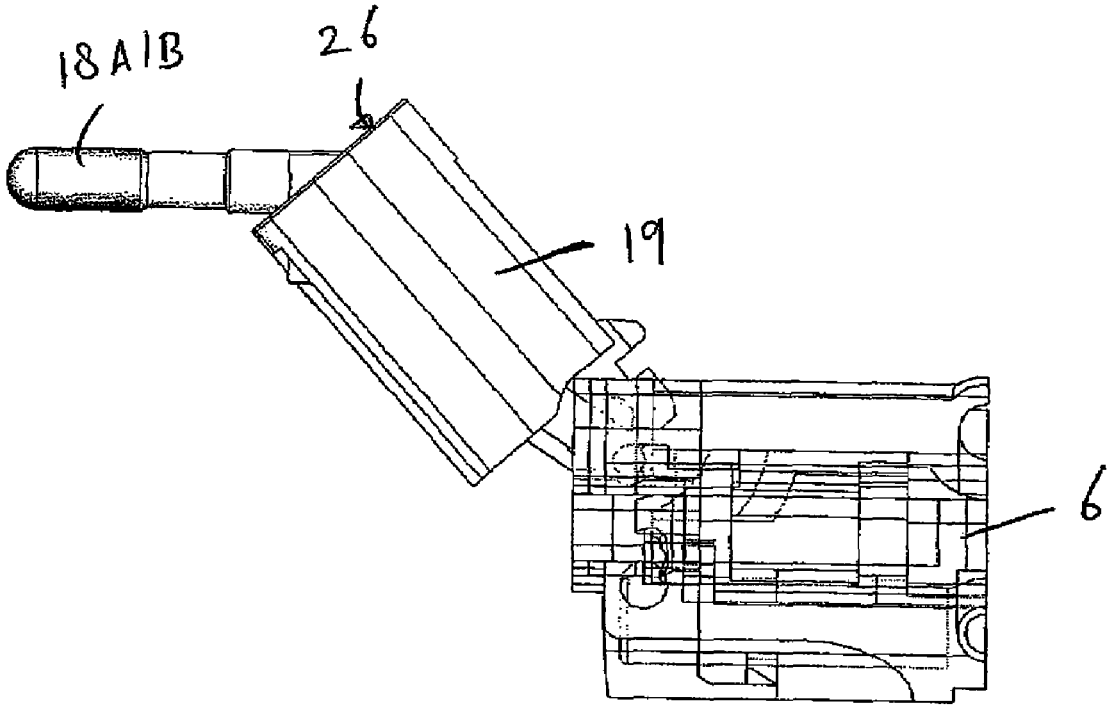
FIG. 33 is a side view of part of the adaptor illustrating transition of motion of the Europlug pins between the stored and active condition.

The adaptor 1, with reference to FIGS. 6 and 7, also includes a non-circuit pin 15 that can move (preferably by rotation) relative to the housing from a stored condition to an active condition for establishing a British pin plug configuration as shown in FIG. 7. The non-circuit pin 15, shown in transition between its stored condition and active condition in FIG. 6 is rotatably mounted about an axis 16 as shown in FIGS. 26, 29 and 32 so that in its active condition as shown in FIG. 7, the pin 15 projects in a direction parallel to the circuit pins 10A and 10B. The non-circuit pin 15 of the British pin plug configuration of the adaptor is provided for activation of a safety screen that may be provided on some British pin sockets. Such a safety screen is first activated prior to allowing for the circuit pins 10A and 10B to penetrate the terminals of a British pin socket. Accordingly it is desirable that where the adaptor provides for connection to a British pin socket that such a non-circuit pin 15 is provided. The non-circuit pin 15 may be presented adjacent to the first end face 7 of the adaptor rather than extending from the first end face 7 as is required for the circuit pins for reasons that are hereinafter explained. As a result of the non-circuit pin 15 being able to be presented adjacent to the first end face 7, the depth D of the adaptor housing does not need to take account for the positioning of the non-circuit pin 15 in its active condition. The height "H" of the adaptor is preferably not much greater than the length needed to accommodate the pins (and related extensions facility movement) in their lengthwise direction.

Figure 9:
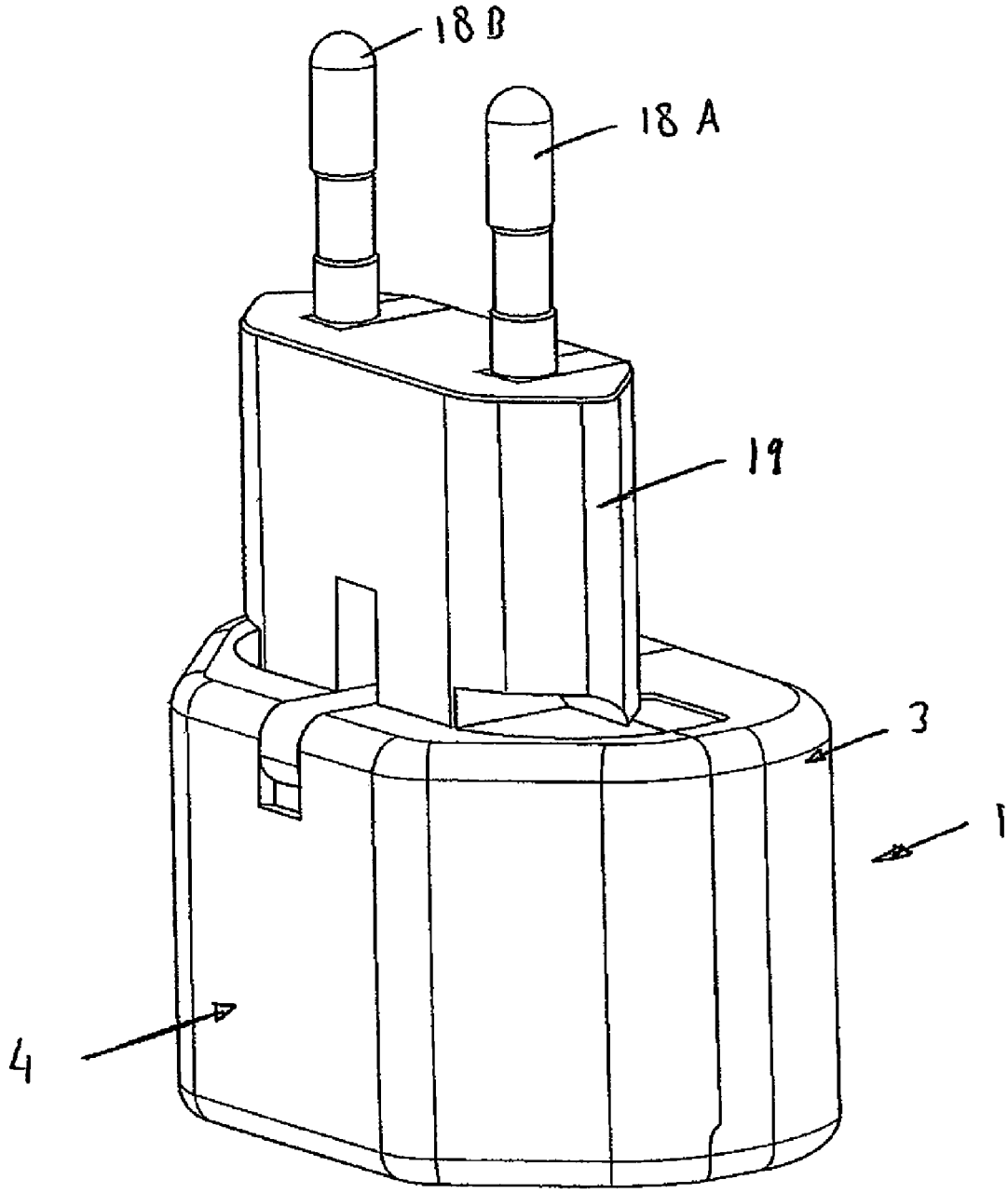
FIG. 9 is a perspective view of the adaptor wherein the Europlug is presented in the active condition.
Figure 10:
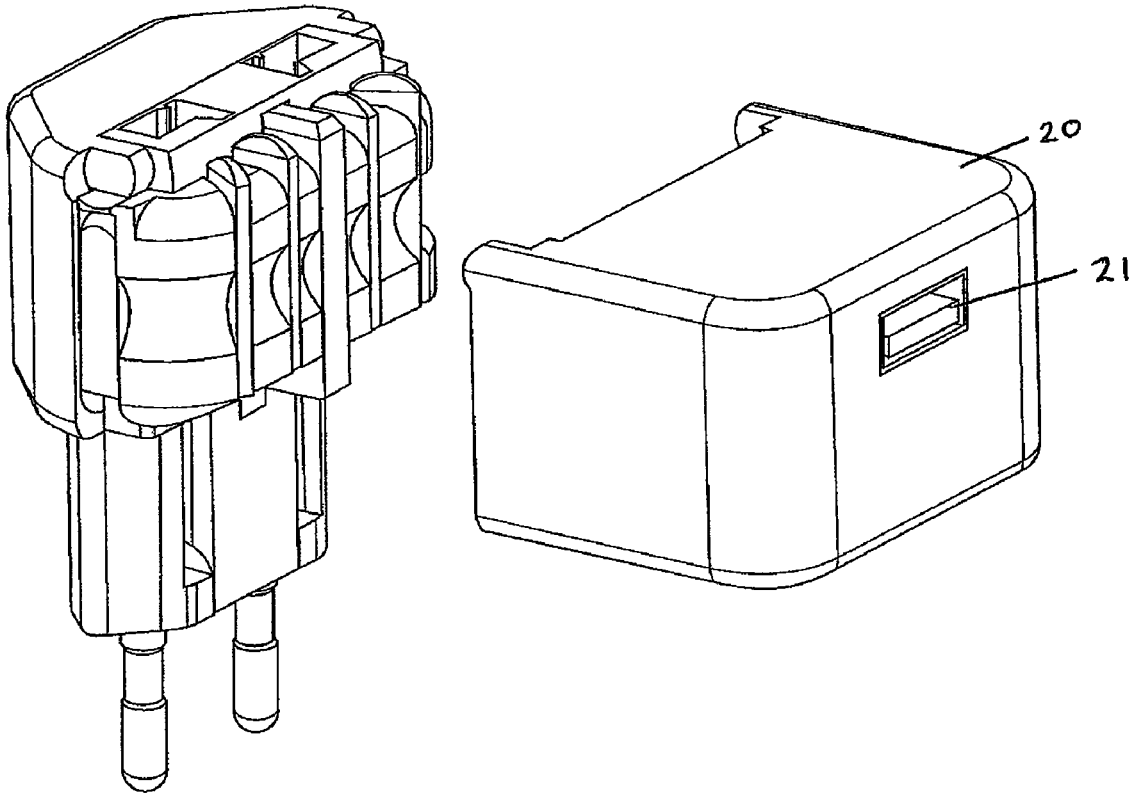
FIG. 10 illustrates a perspective view of the adaptor wherein part of the housing can be removed from the other parts of the housing.
Figure 11:
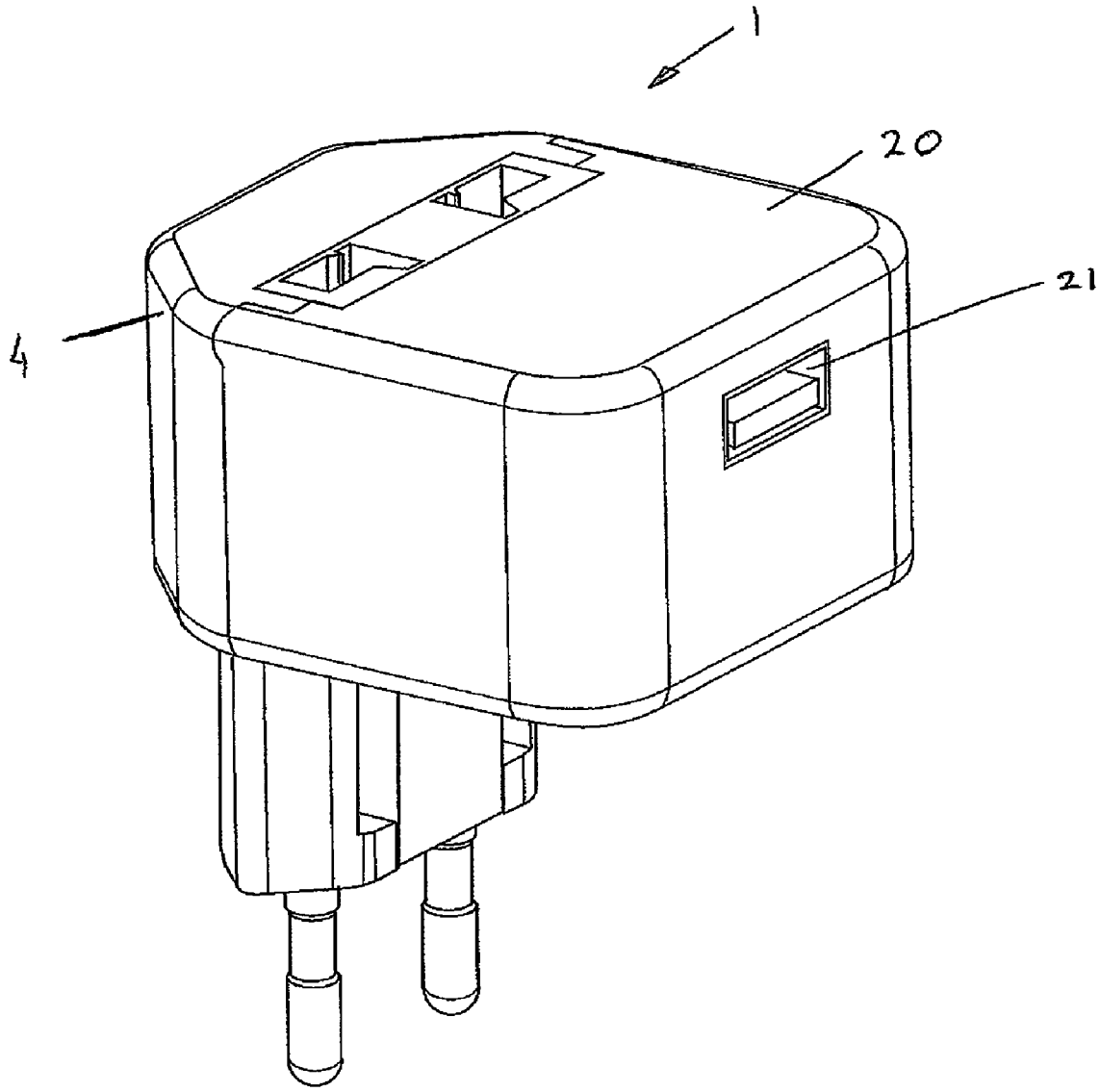
FIG. 11 is a perspective view of the adaptor of the present invention wherein an auxiliary component is engaged to the housing, the auxiliary component including a socket and with which a plug of a DC voltage device may be inserted, the auxiliary component also including a transformer for the transformation of AC voltage to DC voltage between the adaptor pins and the auxiliary component socket.

The live pin and the neutral pin for forming a British 3-pin plug at the adapter can become active or inactive by rotating these two pins about their respective hosing mounted ends and in opposite directions to each other. This is preferred over co rotation like that of the North America and Australia pins as it provides space-spacing. This is so because each of the two British pins is a rectangular prong which takes up less space when rotating it in and out of the housing in a counter rotating manner and towards each other than when rotating it a co rotating manner thereby allowing more space for fitting other components of the adapter. Also capable of being presented by the adaptor 1 are a Europlug pins 18A and 18B as shown in FIG. 9. The components for providing the Europlug pins are preferably located in their stored condition, on the opposite side of the housing to where the other pin pairs are provided. Preferably the components are, in their stored condition provided under cover of the cover member 4. The cover member 4 may preferably also rotate relative to the base part 6 about the axis X-X to, in its opened condition allow for the Europlug pins to be manipulated for the purposes of movement between their stored and active condition. The Europlug pins 18A, 18B present themselves from an intermediate body 19 that may be moved also from its stored condition, retained within the housing, to an active condition where the pins project in a direction that is parallel to the direction in which all other pins project when in their active condition.

When presented for use, each of the pins preferably extend in the same direction. Hence when inserting the adaptor into a plug, the movement is always in the same direction for each of the plugs. The socket of the adaptor will hence be presented in the same direction (though rotational orientation may vary due to for example the Europlug being capable of insertion at two 180 degree orientations). This can ensure safety of use allowing only pins of one kind of plug to be configured in the active position each time the adaptor is being used.

Each of the pins, in their stored condition, preferably do not make an electrical connection with the socket terminals of the adaptor. It is only once rotated to their active condition that they make a connection with the adaptor socket terminals. This is achieved by appropriate positioning of the link bars within the adaptor, as for example shown with reference to FIGS. 61 and 62.

The adaptor 1 may be configured to receive an auxiliary housing 20. The auxiliary housing 20 may include connection terminals to make an electrical operative connection to the adaptor pins projecting from the adaptor and may include a transformer to step down the voltage and convert AC voltage to DC voltage to allow for a DC voltage device to be plugged into the auxiliary housing 20 at the housing socket 21. The housing socket 21 may for example be a USB connection socket.

Other than the adaptor 1 being capable of being configured with an auxiliary housing 20 attached, the adaptor 1 is preferably a self-contained item that does not require the removal and replacement of component parts for transformation of the adaptor for use with different electrical sockets and electrical plugs.

Figure 34:
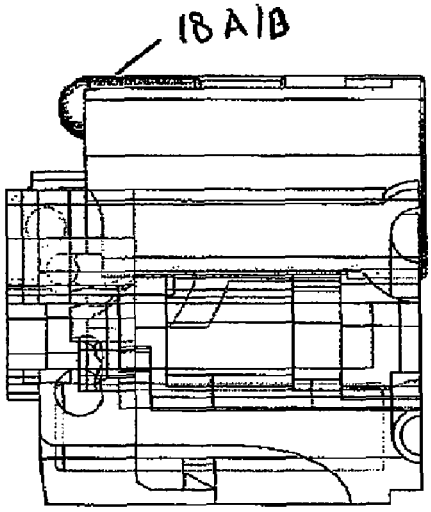
FIG. 34 is a side view of part of the adaptor illustrating the Europlug pins in their stored condition but wherein no cover of the housing is located over the pins.
Figure 36:
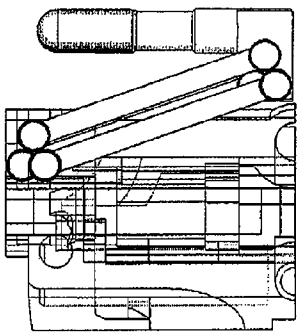
FIGS. 36-41 illustrates various conditions and various components of the adaptor and the Europlug pins.
Figure 38:
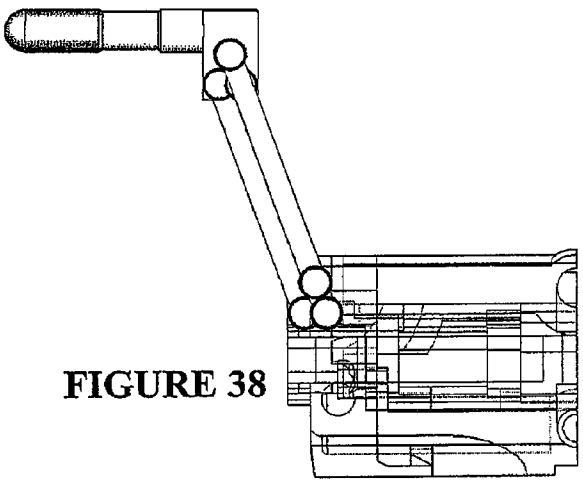
Figure 35:
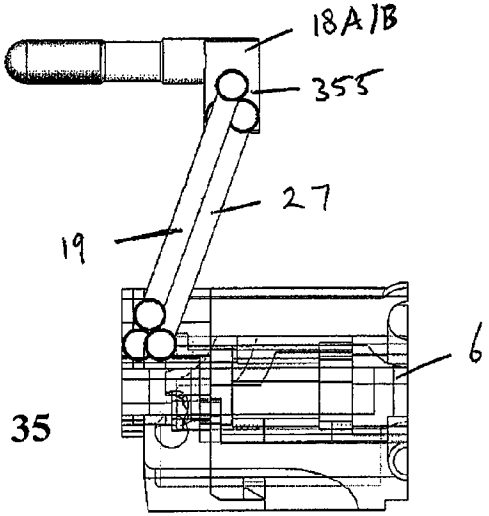
FIG. 35 is a side view of part of the adaptor illustrating three arms defining the intermediate articulation member between the housing and the Europlug pins.
Figure 37:
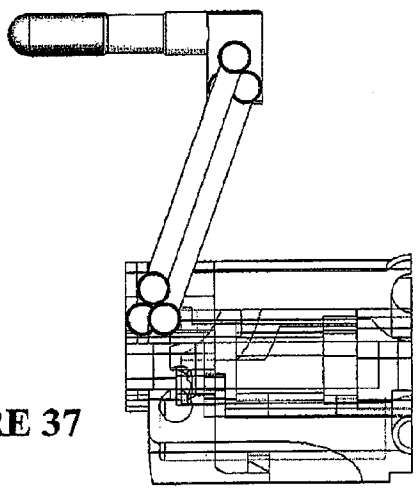
Figure 40:
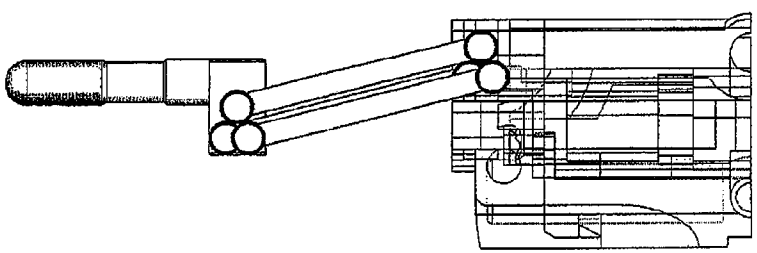
Figure 42:
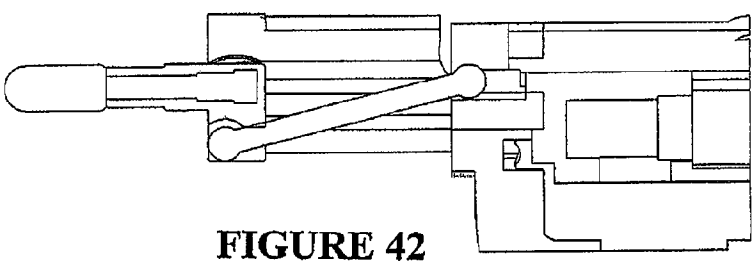
FIG. 42 is a side view of an adaptor and wherein one of the arms is illustrated as being substituted by an intermediate body.
Figure 39:
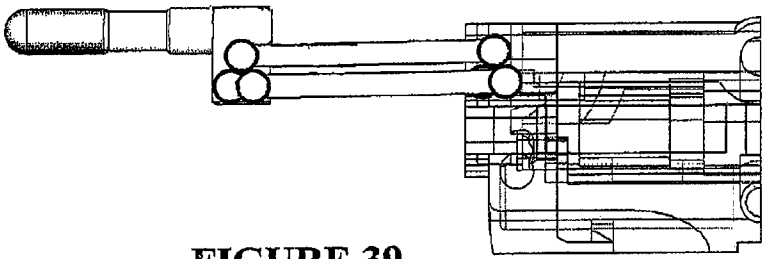
Figure 41:
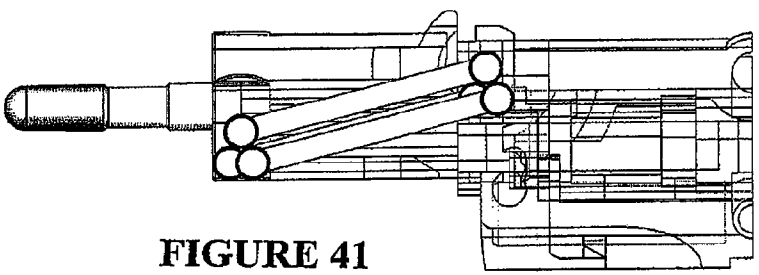

Motion of the Europins is shown with reference to FIGS. 33-49. In FIG. 34, the Europins 18A/18B are shown in their stored condition. The Europins move relative to the base member 6 of the housing in an articulated manner between the stored condition as shown in FIG. 34 and the active condition as shown in FIG. 9. Articulation occurs by an intermediate member 19 that is pivotally mounted relative to the base member 6 and relative to the pins 18A and 18B. The intermediate member 19 includes an end face 26 from which the Europins 18A/18B extend when in the active condition. The end face 26 is of a size appropriate to allow for the Europins 18A/18B to be inserted in respective terminals of a Europin socket. The intermediate member 19 may comprise of a plurality of link bars 27 that at or towards each of their distal ends are pivotally mounted respectively to the base member 6 and the Europins 18A/18B. A four-bar-chain or parallelogram like linkage can be established by the link members 27. The link members 27 offer rigidity of connection between the base member 6 and the Europins 18A/18B, in the stored condition and/or the transition condition and/or the active condition of the Europins 18A/18B.

Figures 49A, 49B, 49C, 49D, 49E:
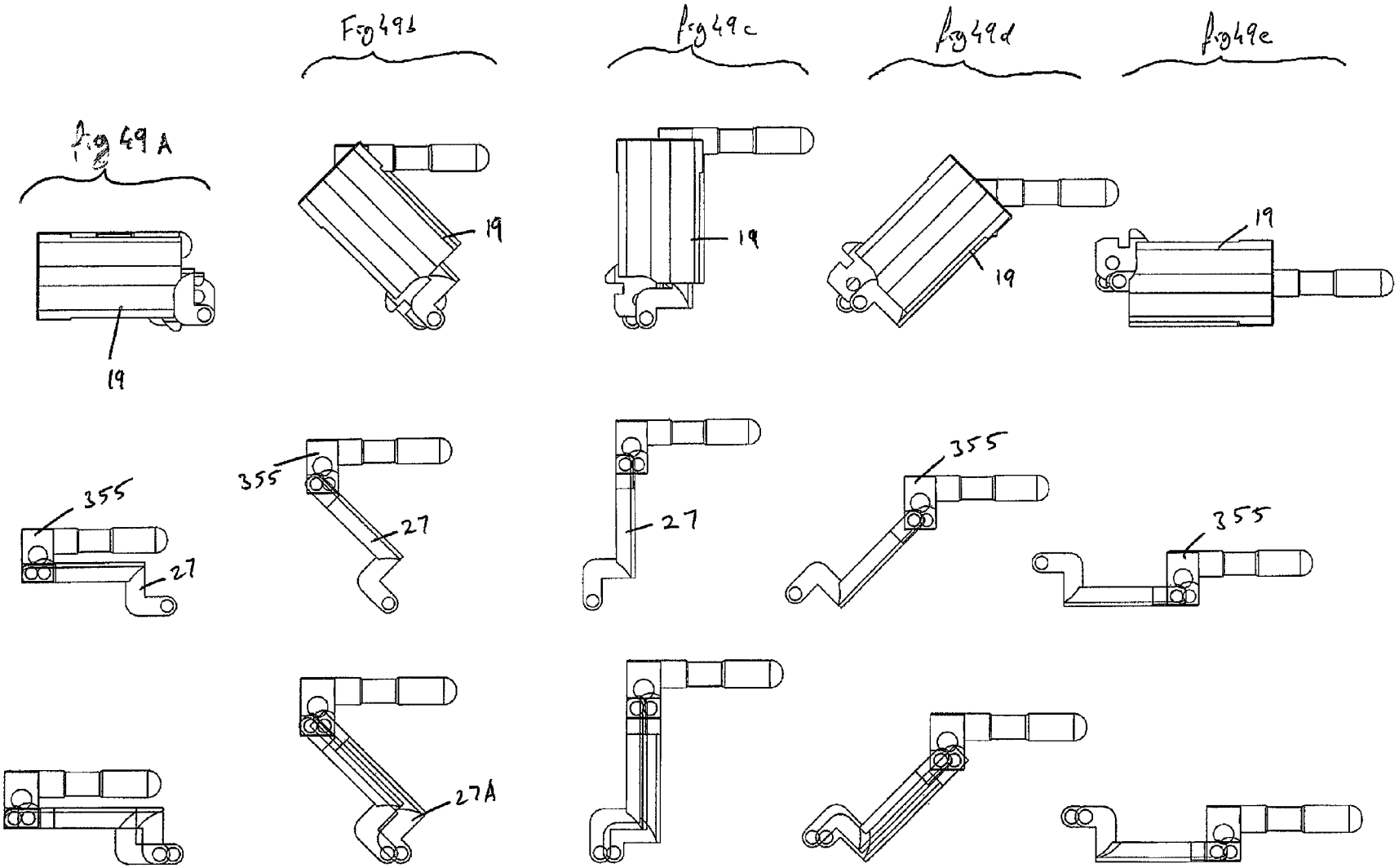
FIGS. 49*a*-49*e* show components of the adaptor associated with the Euro pin plug in different stages of assembly, and at different stages of movement between a collapsed condition and an erected condition.
Figure 50:
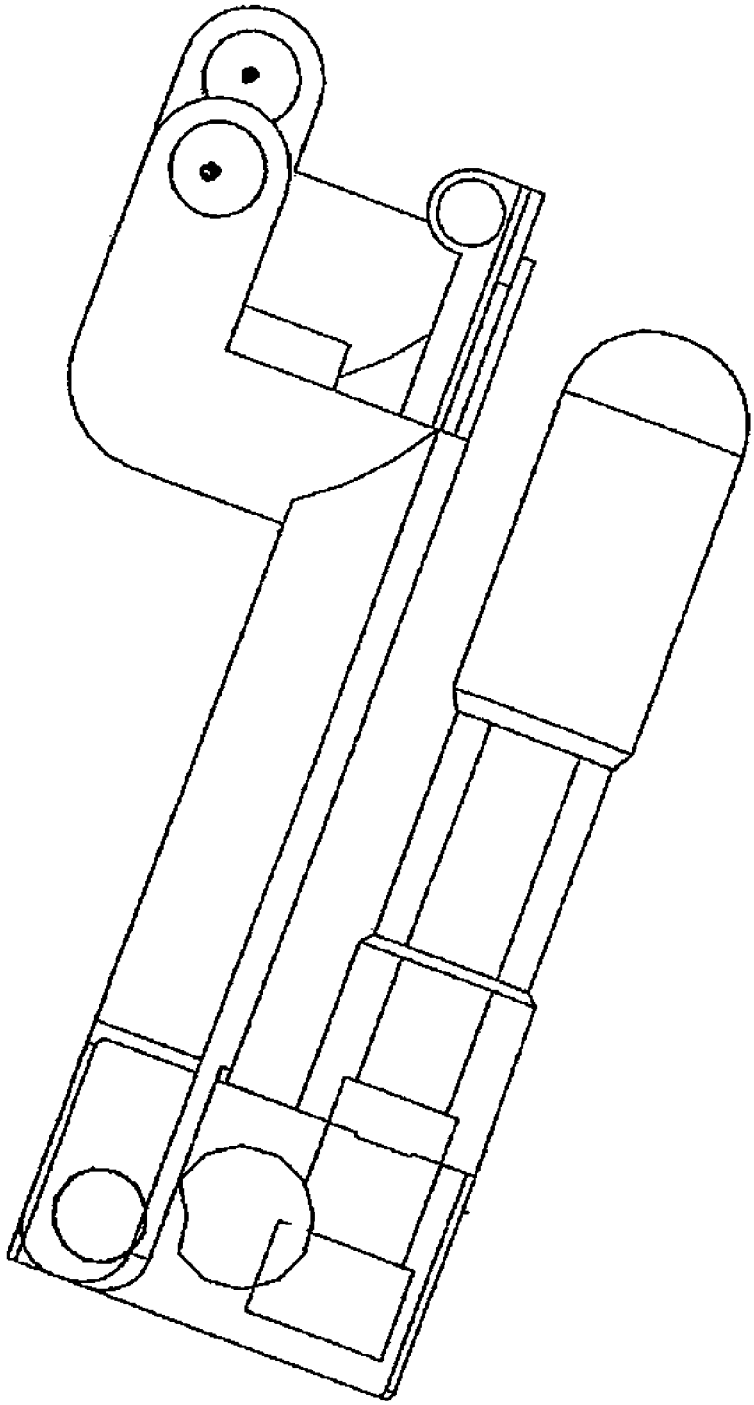
FIG. 50 is a side view of two of the arms acting intermediate of the Europlug pins also shown as FIG. 50.
Figure 51:
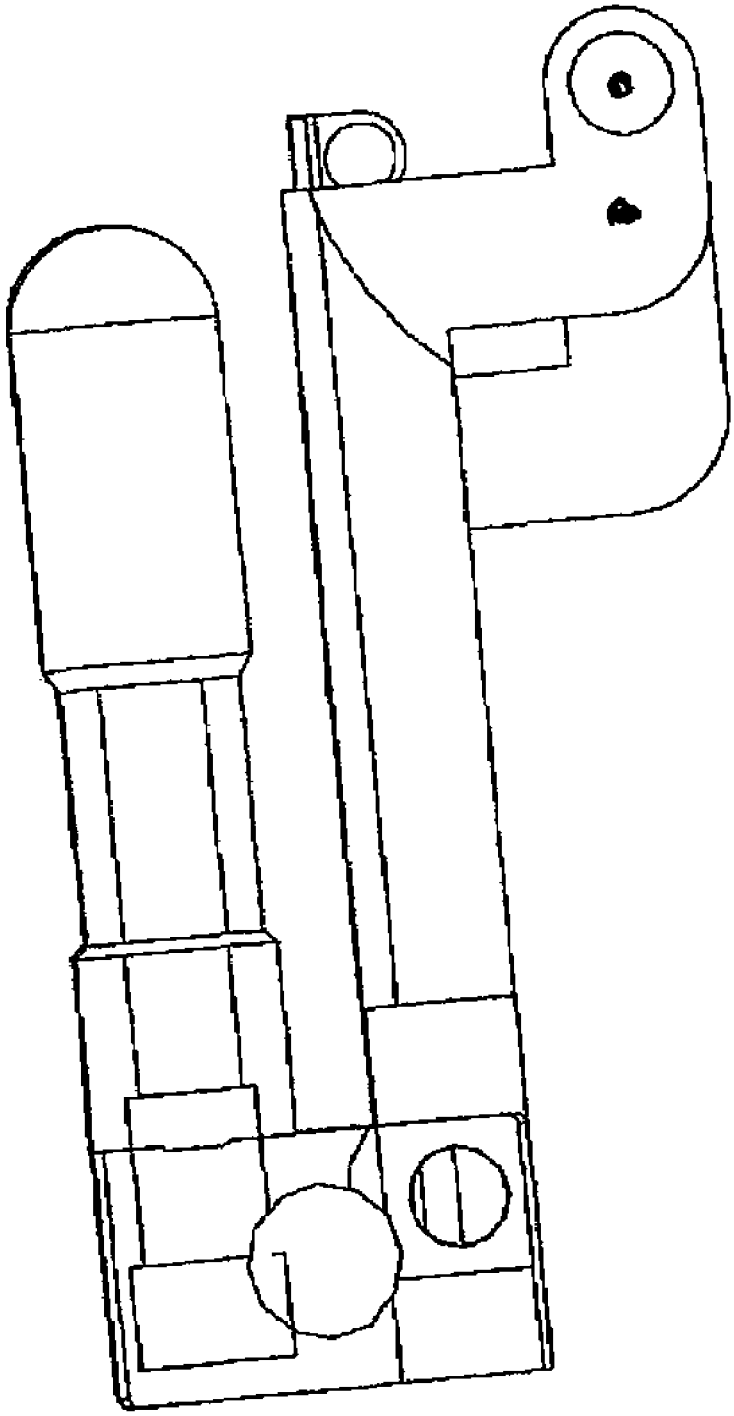
FIG. 51 is an opposite side view of FIG. 50.
Figure 52:
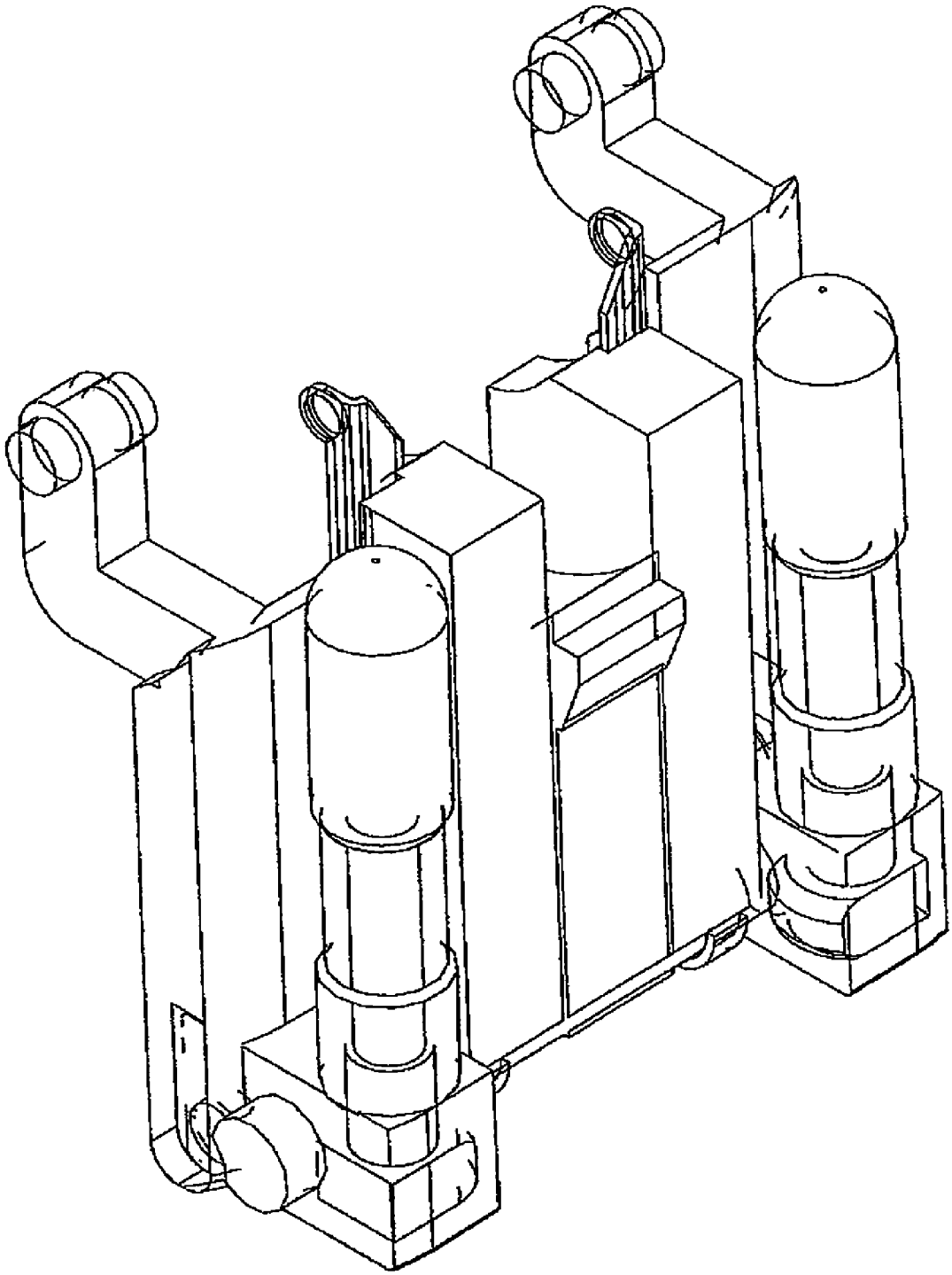
FIG. 52 is a perspective view of components provided intermediate of the Europlug pins and the housing.
Figure 53:
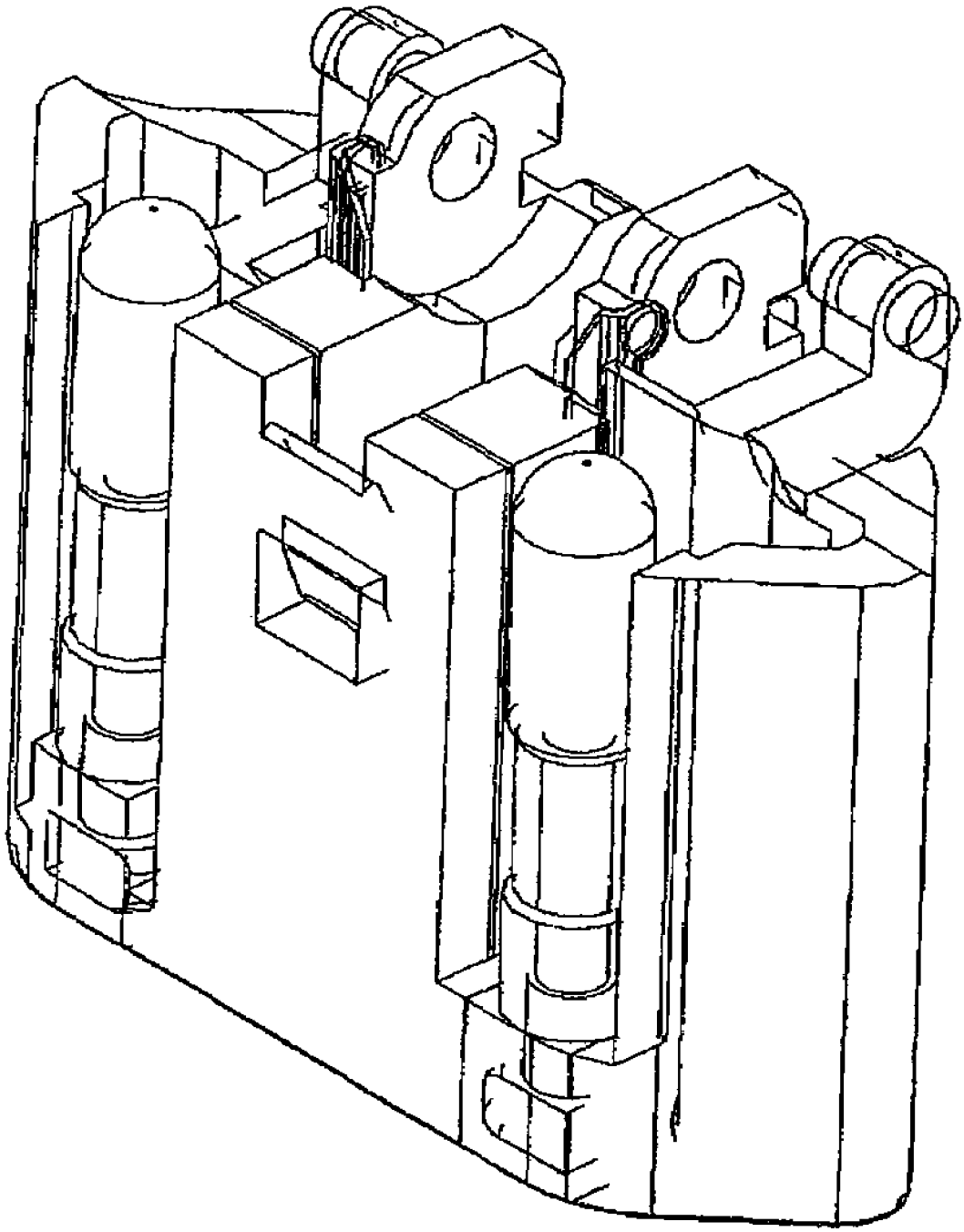
FIG. 53 is a different perspective view and with other components shown in relation to that shown in FIG. 52.
Figure 54:
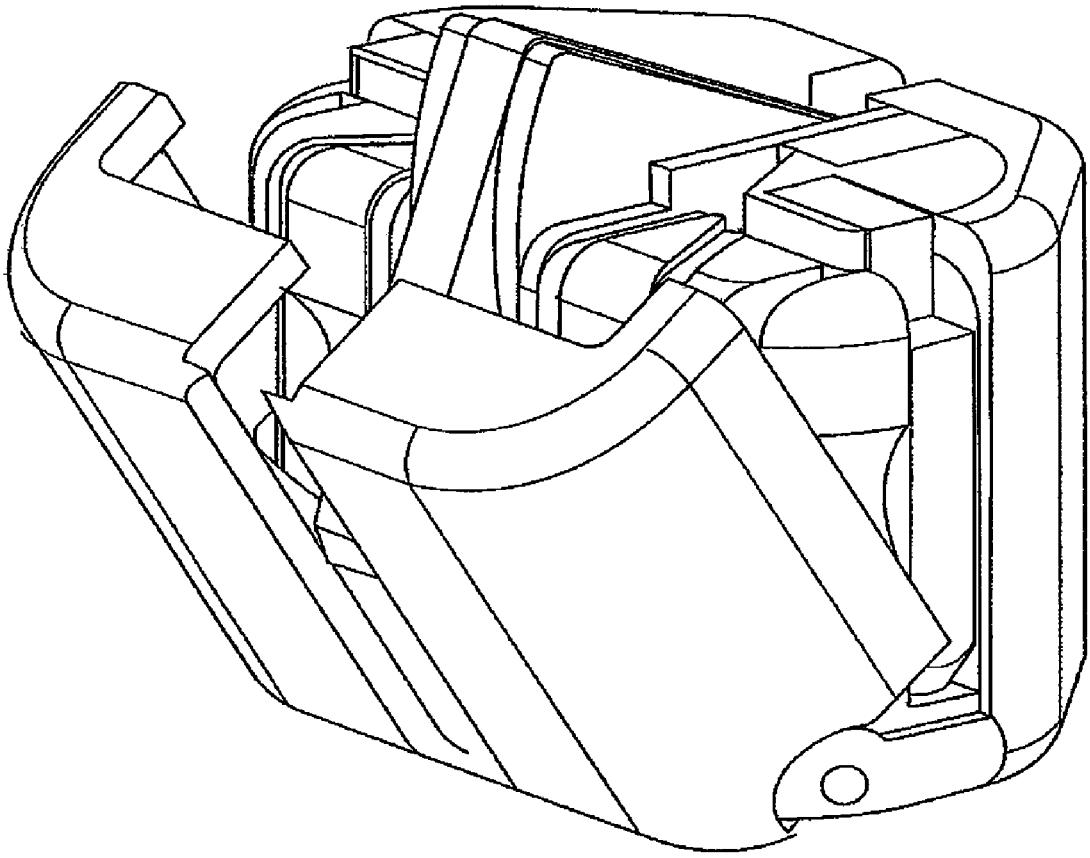
FIG. 54 illustrates a perspective view of the adaptor wherein part of the housing has been moved to allow for movement of non-circuit pin (e.g. earth or dummy pin) of the British three-pin plug to occur and wherein this is shown in transition between its stored condition to the active condition and wherein also an interference member becomes presented above the first face end during transition of the pins of the British three-pin plug from their stored condition to the active condition.
Figure 55:
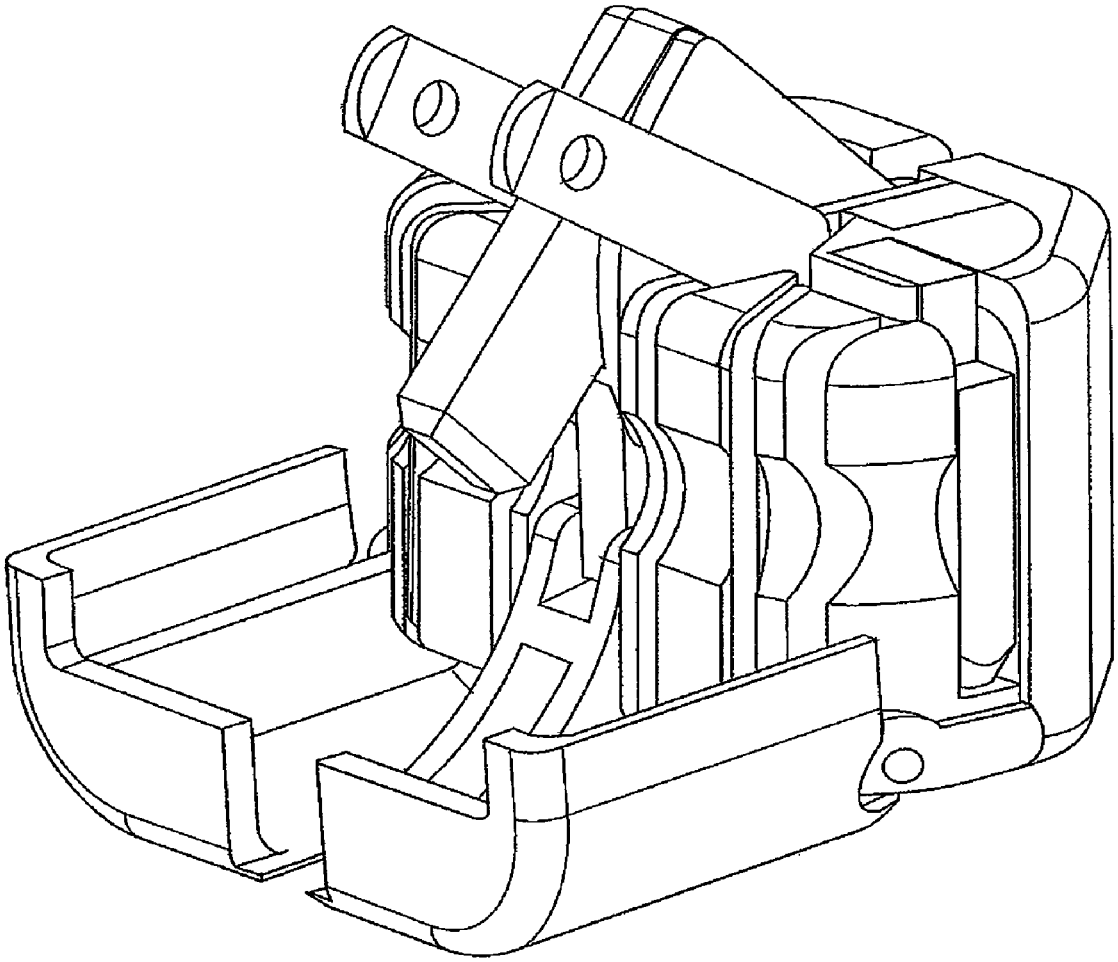
FIG. 55 shows further movement from the stored condition to the active condition.

With reference to FIGS. 49*a*-49*e*, the movement of the intermediate member 19 is through 180 degrees. Therefore the parallelogram formed by the base member 6, the intermediate member 19, the pin mount 355 and just the link bar 27 will align at some point. At the aligned point, the arrangement becomes unstable. To create stability over the entire range of movement a second lever 27A is used. An additional benefit is that each lever can remain parallel to the intermediate member over the range of movement and in the stored condition and erected condition is parallel to the Europins. In the stored condition, the levers move to create a recess into which the Europins can locate as shown in FIG. 49A. The pins then sit within this recess of the intermediate member 19.

Figure 56:
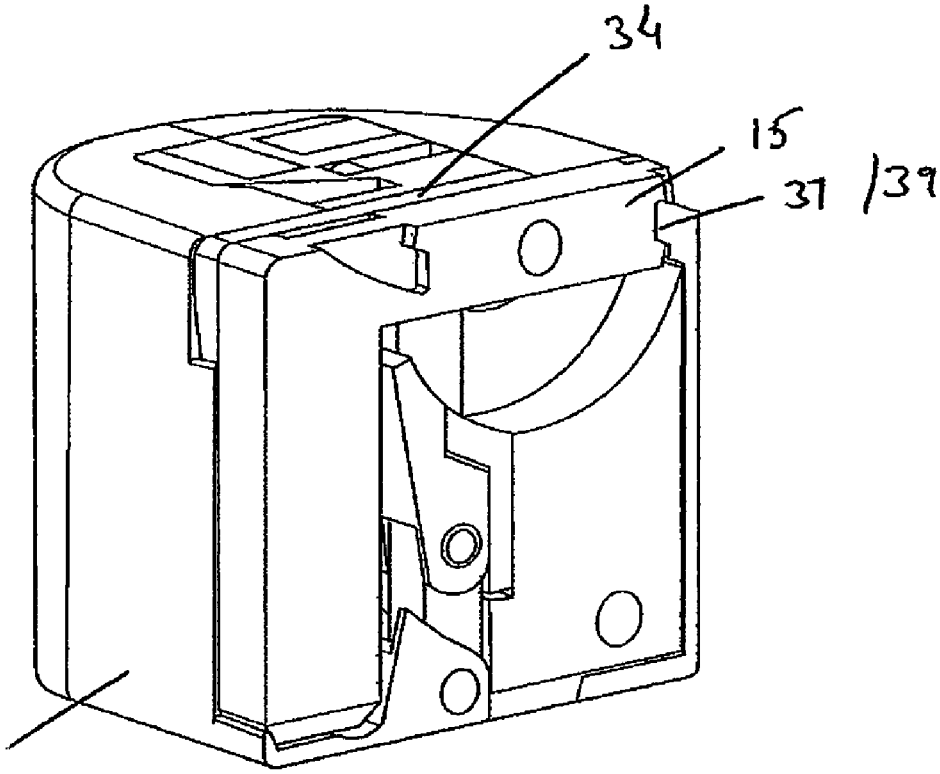
FIG. 56 is a partial sectional view of the adaptor to illustrate the mechanism relating to the interference member.
Figure 57:
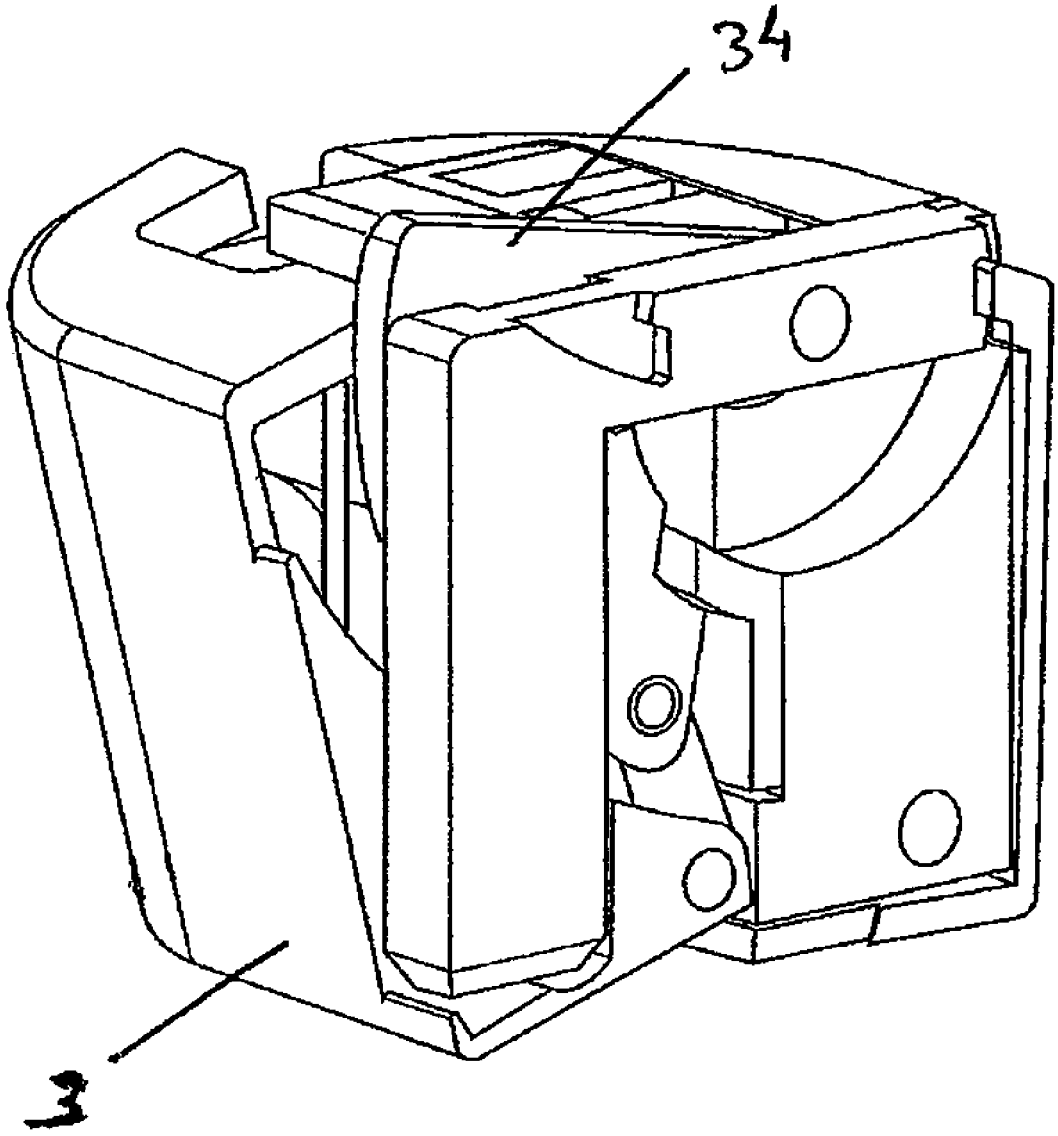
FIG. 57 shows a partial sectional view of the adaptor to illustrate the mechanism relating to the interference member in a condition displaced from that shown in FIG. 56
Figure 58:
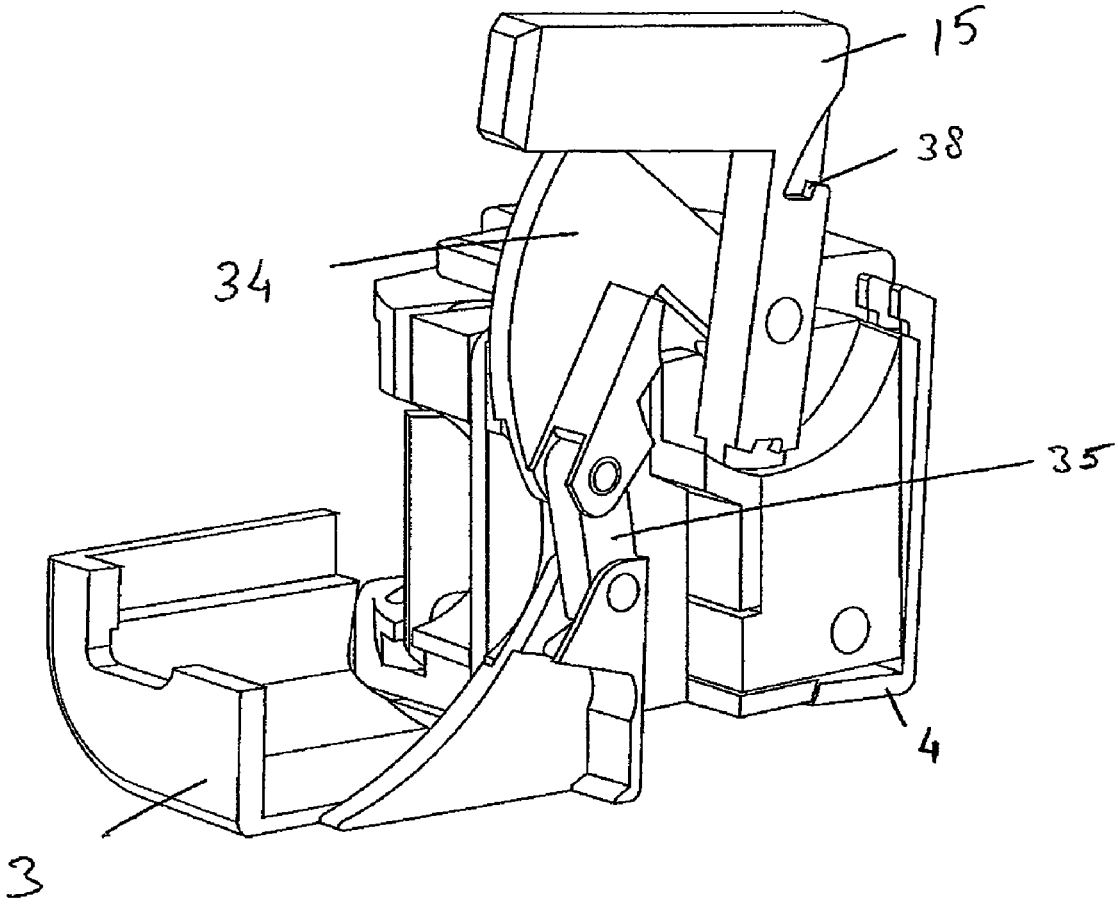
FIG. 58 is a partial perspective view of FIG. 57 in a different condition.

With reference to FIGS. 54-58, there is illustrated a safety mechanism that can prevent the use of the adaptor during transitional movement of, for example, the British pins from their stored condition to their active condition and vice versa. As has previously been mentioned, in order to move the British pins from their stored condition to their active condition and vice versa the cover member 3 needs to be moved to open the enclosure of the adaptor. Such movement is shown with reference to FIG. 57. Associated with the cover member 3 and in a operative engagement therewith, is an interference member 34. The interference member 34 moves between a stored condition as shown in FIG. 56 to an extended condition as shown in FIG. 58 dependant on the movement of the cover member 3. In conditions other than when the cover member 3 is in a closed position, the interference member 34 projects from the first face end 7.

For example it can be seen that the interference member 34 is lifted by a link member 35 that is pivotally engaged to the cover member 3 and the interference member 34, when the cover member moves from its closed position towards the open position. The interference member 34 projects sufficiently high above the first end face 7 so that the British pins, which may be presented in their active condition, cannot sufficiently penetrate the electrical socket terminals to make an electrical connection with an electrical socket.

Figure 59:
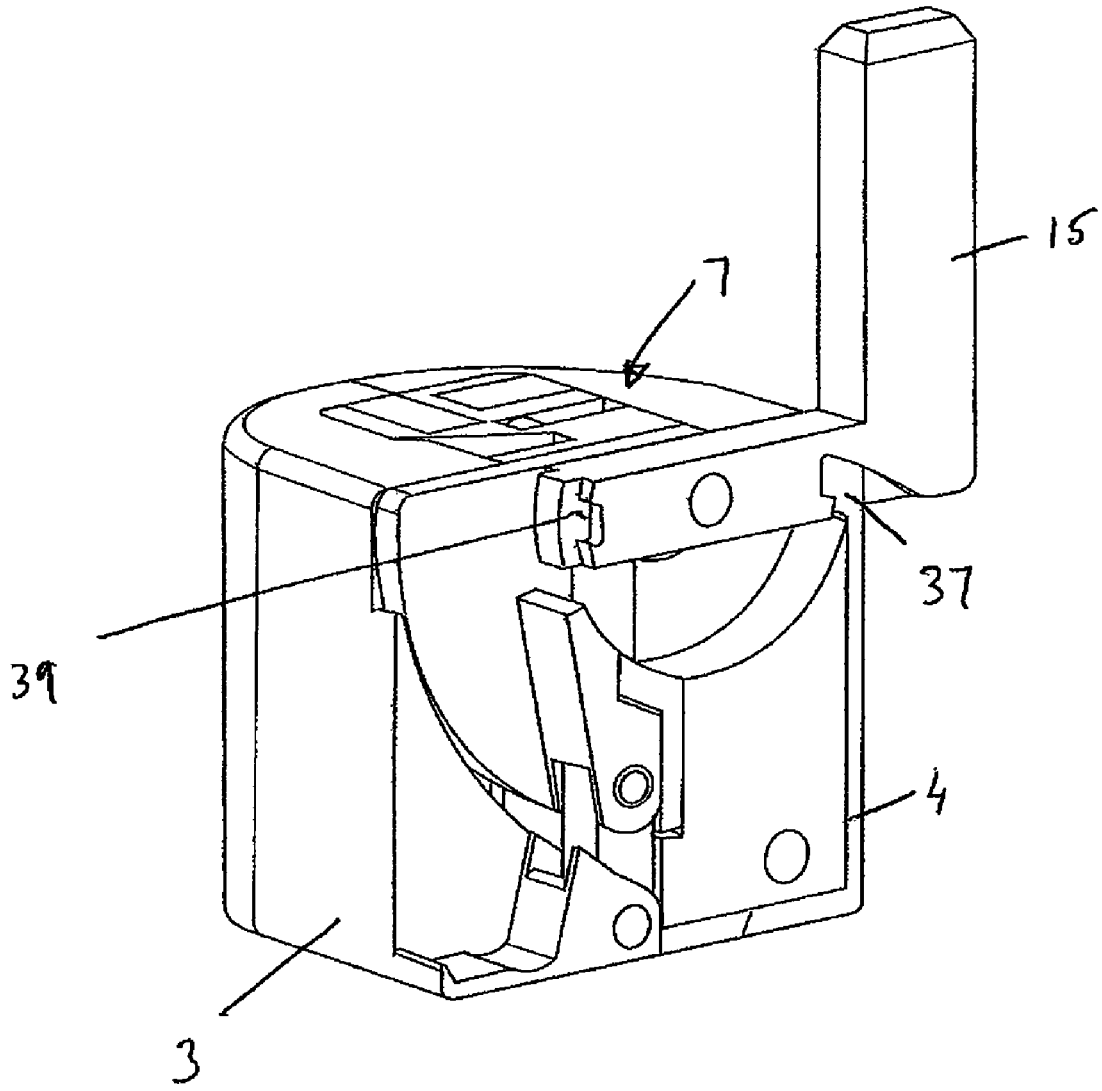
FIG. 59 is a partial sectional view in yet a further condition.
Figure 60:
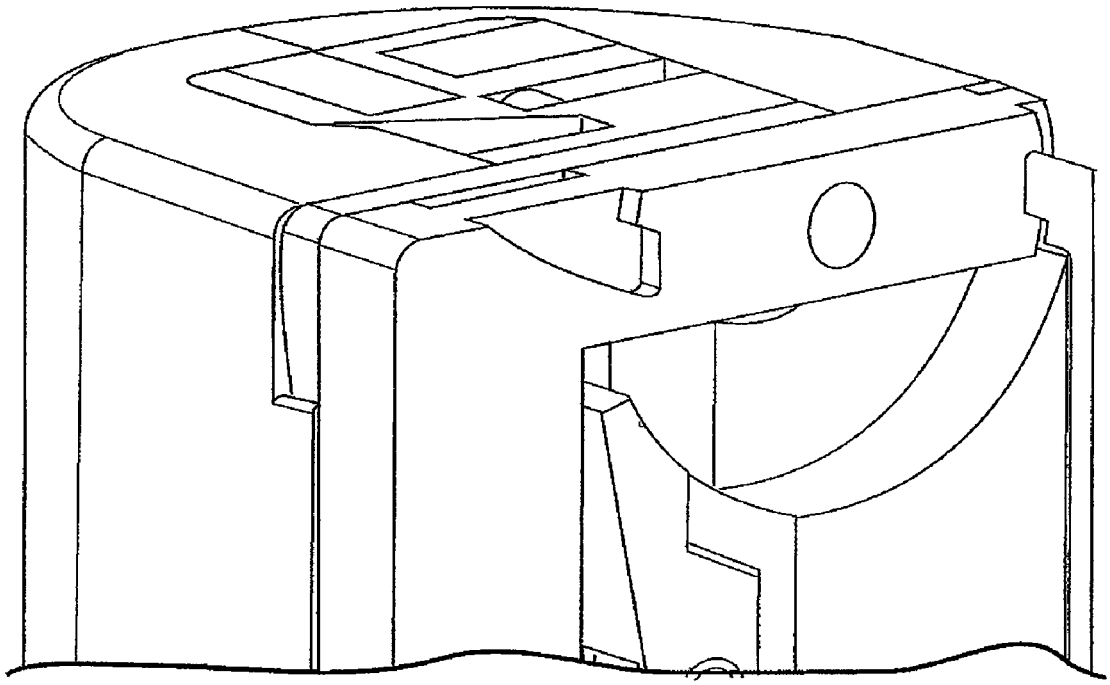
FIG. 60 is a close up partial sectional view illustrating components in relation to the interference member.

Also with reference to FIGS. 56-59, there is shown a lock feature 37 that is provided by the second covet member 4 that can engage with a complimentary surface 38 of the non-circuit pin 15 to lock the non-circuit pin 15 into its active condition as shown in FIG. 59. This may be achieved by slight movement of the second cover member 4 as for example shown in FIG. 58 and upon its return to its fully closed position as shown in FIG. 59. Likewise this feature 37 may also engage with a surface or zone 39 of the non-circuit pin 15 when the non-circuit pin 15 is in its stored condition, to thereby lock the non-circuit pin 15 in its stored condition as for example shown in FIG. 56. The interference member 34 may be operative during movement of all pins under cover of the first cover member 3.

The mechanism may include features so that when the front lid opens, it automatically lifts out the interference member 34 that itself may include a surface or zone that simultaneously presses the second cover member 4 to a partially opened condition so as to free the locking member 37 from the zone 39 and allow for the non-circuit pin 15 to be released for rotation.

The interference member may be provided as an optional safety feature for all pins. By opening the first cover member 3, the interference member will lift out and then it will not be possible to insert the British pins, Australia pins, and North America pins. When the first cover member 3 is open the interference member will also prevent the Europins from moving to a position where they can be inserted into a socket. So this prevents electrical components covered by cover member 3 becoming live when the cover member 3 is not closed.

Figure 12A:
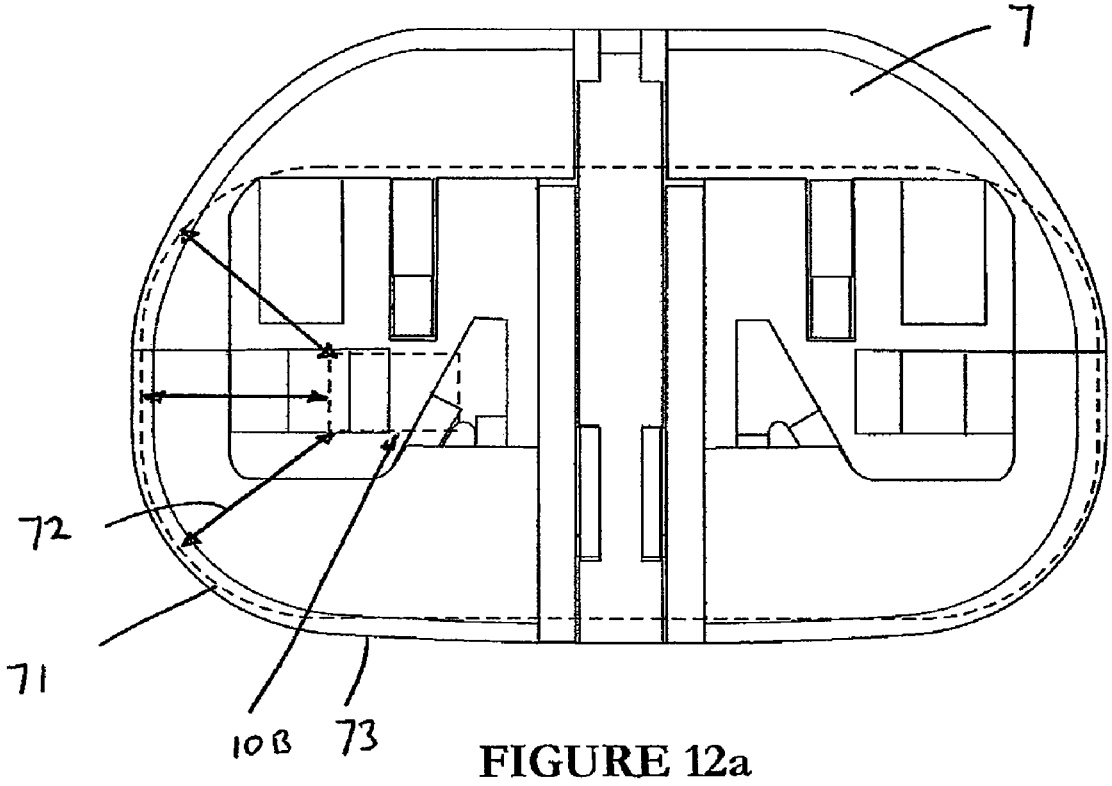
FIG. 12*a* is a plan view of the first end face of the adaptor illustrating an overlay of the dimensions of for example the British standard BS1363 illustrating the perimeter of the adaptor at the first end face at where the adaptor presents its adaptor pins, being of a size sufficient but preferably not significantly larger as to meet this standard.
Figure 12B:
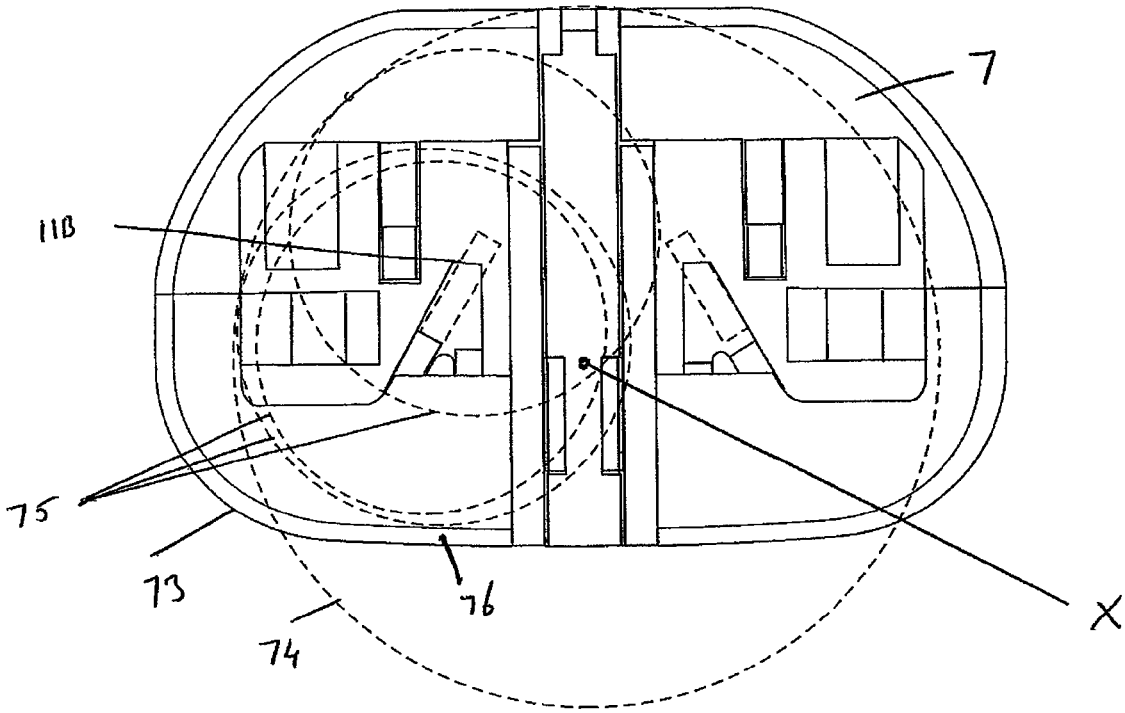
FIG. 12*b* is an end view of the first end face of the adaptor illustrating an overlay of the Australian standard in relation to dimensions surrounding one of the two circuit pins and wherein the perimeter of the first end face is sufficient to lie within the minimum dimensions but not significantly greater than the minimum dimensions.

With reference to FIGS. 12*a* and 12*b*, aspects in relation to the first end face 7 design are undescribed. In FIG. 12*a* there is shown an outline of the British pin 10*b*. The standard for British pin plug designs is that there needs to be at least a 9.5 mm radius from every corner and edge of the pin to the periphery of the end face 7. Dimension 72 therefore needs to be a minimum of 9.5 mm. Shown in phantom is an overlay of a perimeter 71 that would meet the British standard. As can be seen the perimeter at 73 of the first end face 7 follows closely, the perimeter 71. This allows for the adaptor to comply with this British standard.

With reference to FIG. 12*b,* there is shown in outline, the Australian pin 11*b.* The Australian standard specifies that from a mid point X a radius 74 needs to exist to the periphery of the end face of a plug that also includes an earth pin. However the adaptor preferably provides the Australian pins without an earth pin. It provides only the live and neutral circuit pins of an Australian plug configuration.

Accordingly by drawing circles about peripheral points of the pin 11*b,* that are coincident at a tangential point with the perimeter 74, the first end face 7 perimeter 73 can be designed to ensure that such circles 75 do not extend beyond the perimeter 73. In the example shown in FIG. 12*b* the most proximate that the circles get, to the perimeter 73 is at region 76.

Figure 13:
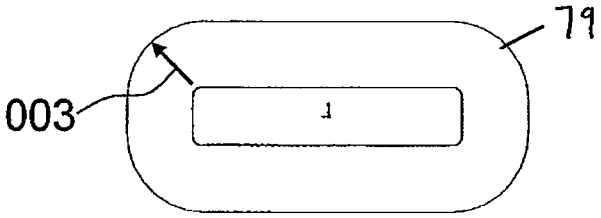
FIGS. 13-15 illustrate design principles which are herein further described.
Figure 14:
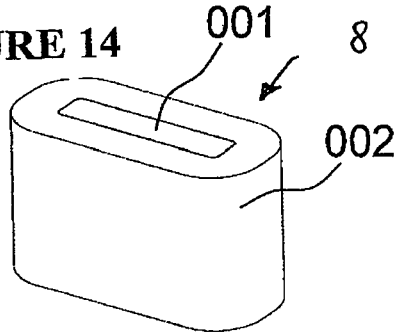
Figure 15:
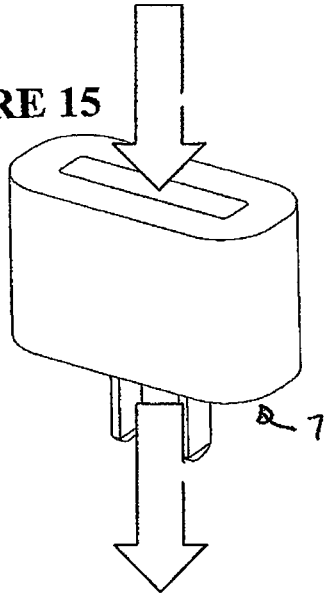

With reference to FIGS. 13-15, there is shown conceptual drawings to explain further design aspects of the adaptor of the present invention. The drawings generally show an outline of the adaptor housing that include a first end face 7 and second end face 8. The housing includes a core zone or region 001 and a peripheral zone or region 002. Preferably the core zone 001 extends from the first end face 7 to the second end face 8.

The perimeter 79 of the peripheral zone 002 is of a size to ensure general safety and/or to meet to the safety standards of plug design. It may also be of a configuration to meet socket design.

The core zone 001 is the zone from which adaptor pins in their active condition are presented. Zone 001 is of a size sufficient to allow for all of the pins that the adaptor is designed to provide for, to be extended from. The size of this zone is dictated firstly by the configuration that pairs of pins need to assume to be able to connect into an electrical socket, and is secondly designed to take into consideration space constraints and mechanism features that need to be provided for by the adaptor to allow for pins to move from the stored condition to the active condition and vice versa. This may not be relevant to an adaptor where Europlug pins are provided as this may be catered for separately and as such other factors come into play in defining the overall size of the housing of the adaptor.

On the basis that all pins can be mounted by the housing so as to be presented from the core zone 001 from the first end face 7, the perimeter 79 of the peripheral zone 002 can then be designed to just meet the periphery design requirements set by the various standards that dictate plug design for the various plugs that the adaptor may be able to be configured to.

With reference to FIGS. 18, 19 and 20 it can be seen how the circuit pins of the Australian plug configuration, United States plug configuration and British plug configuration can be presented from the core zone at the first end face. FIG. 21 shows a Europin plug configuration wherein the pins may not necessarily extend from the core zone 001 nor are in line above the core zone 001.

Figure 22:
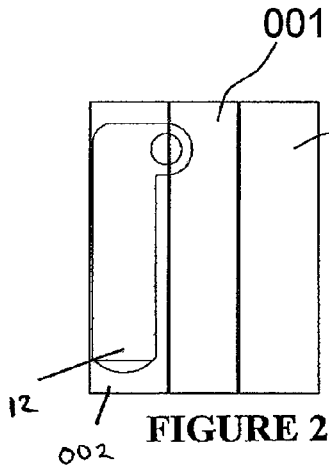
FIGS. 22-24 illustrates a side view of an adaptor with components removed for convenient illustration of the design principles that are herein described with corresponding reference to FIGS. 13-15 and FIG. 20.
Figure 23:
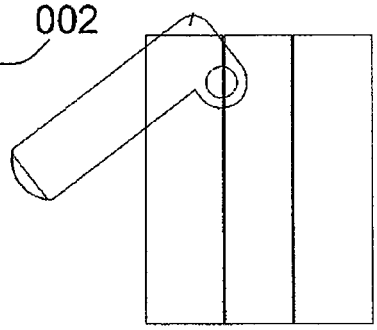
Figure 24:
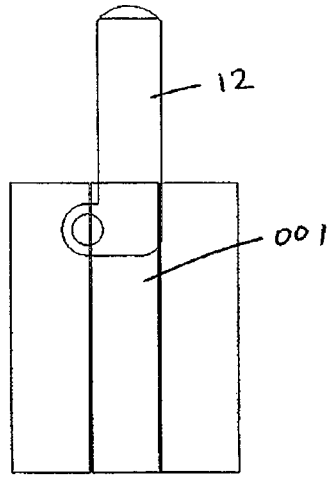

FIGS. 22-24 show side sectional views of FIG. 15 wherein the pin 12 transitions from a stored condition shown in FIG. 22, primarily located within a peripheral zone 002 when in a stored condition, then to an active condition shown in FIG. 24 presented primarily from the first end face, immediately adjacent to the core zone 001.

Figure 16:
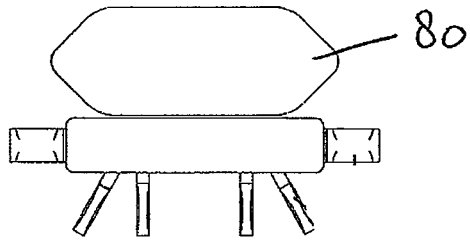
FIG. 16 is a plan view of the adaptor with components removed for convenient representation of the elements defining and/or holding the adaptor pins.
Figure 17:
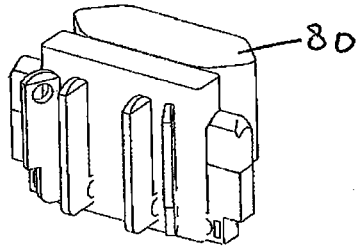
FIG. 17 is a perspective view of FIG. 16, FIG. 18-21 illustrate with reference to FIGS. 13-15 design principals that are herein further described.

Increase in the peripheral profile of the peripheral zone may need to occur to also accommodate the Europlug pins and related mechanism 80 shown in FIGS. 16-17.

Figure 61:
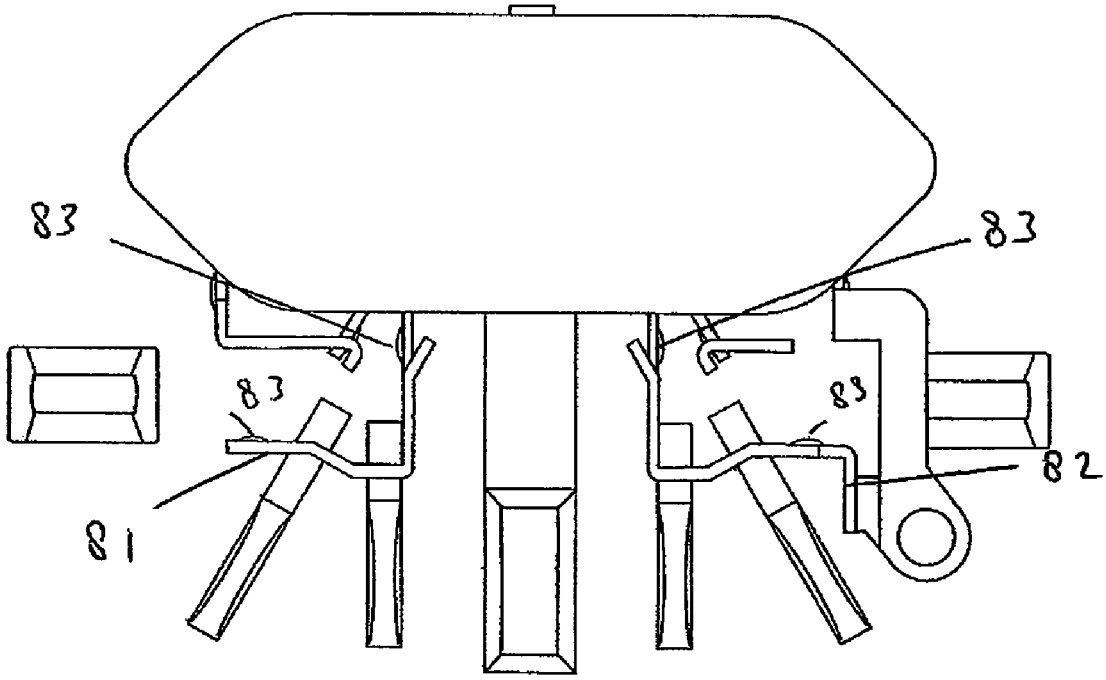
FIG. 61 is a plan view of part of the adaptor with components removed for convenient illustration of the link bar or bars for the provision of electrical connection between the adaptor pins and the adaptor sockets.
Figure 62:
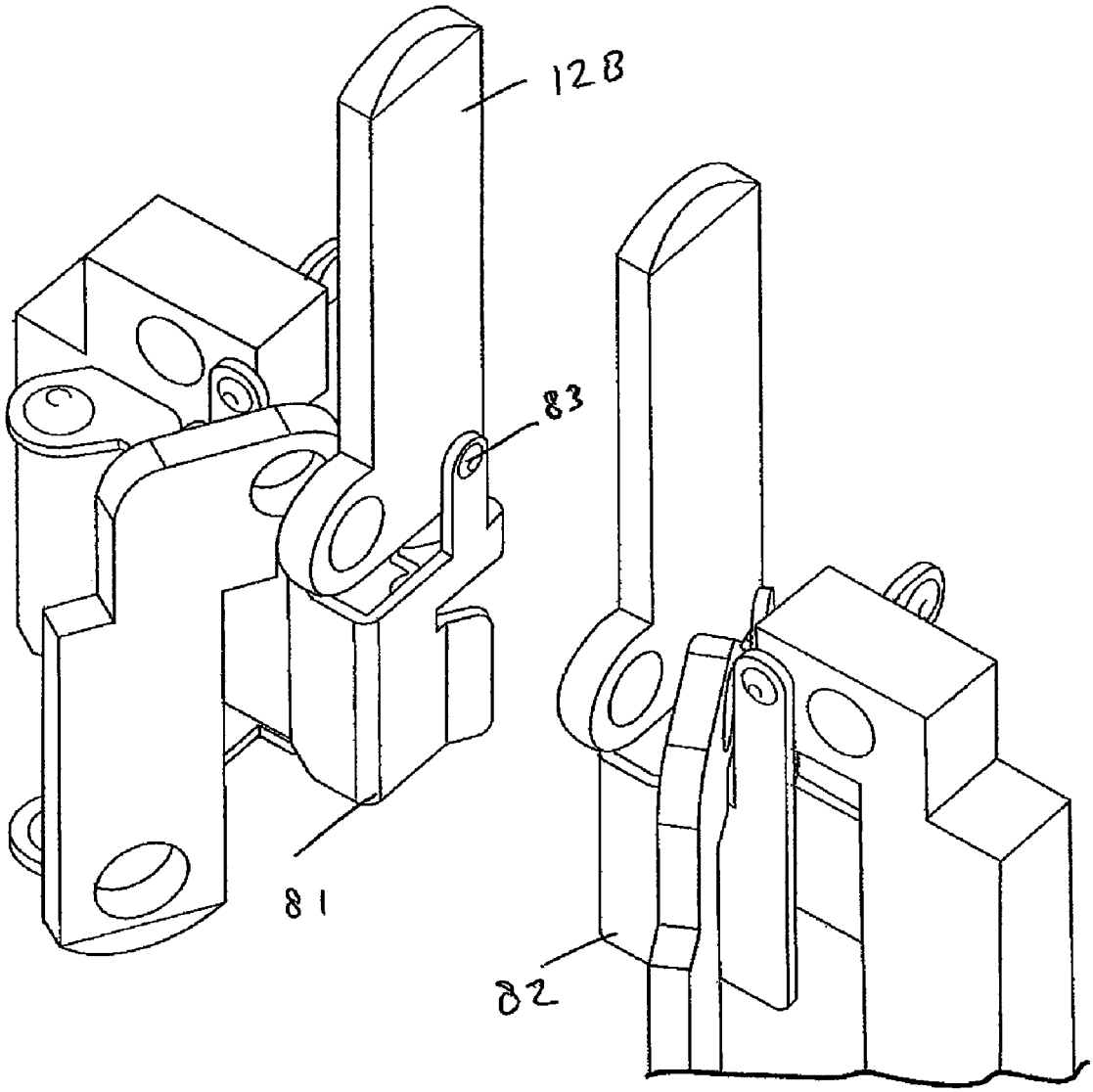
FIG. 62 is a perspective view of part of the adaptor for convenient illustration of the link bar or bars for the purposes of establishing electrical connection between the adaptor pins and the adaptor sockets.

With reference to FIGS. 61-62, there are shown link bars 81 and 82 that are provided for the purposes of making a connection between electrical plugs and electrical sockets via the adaptor and via the adaptor pins and at the sockets. Contact points such as contact points 83 are provided by each of the link bars in a location such that a pin such as the pin 12*b,* makes contact with the contact point 83 only when the pin is approximate to and at its active condition. This ensures that an electrical connection between the adaptor socket and the adaptor pins is not made until a pin is in or proximate to its active condition. In a stored condition the pins preferably do not make an electrical connection with the adaptor socket(s).

Where reference herein is made to an electrical socket it may mean something into which a electrical plug can be inserted. Such an electrical socket may include at least electrical two terminals, one live and one neutral terminal, and may also include an earth terminal.

Where reference herein is made to an electrical plug it may mean something that includes at least two pins forming electrical terminals that can be inserted into the terminals of an electrical socket.

Figure 63:
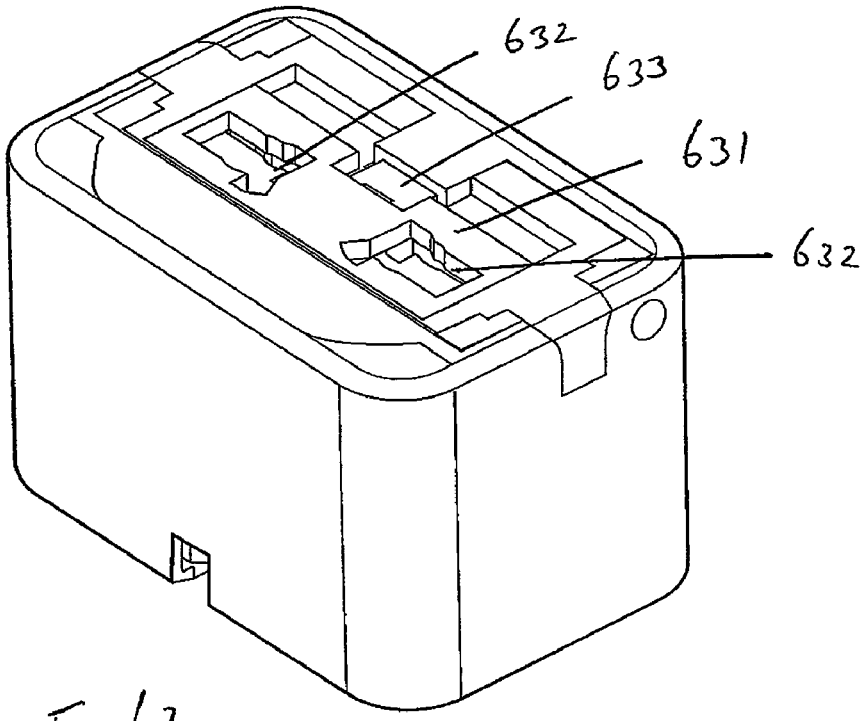
FIG. 63 is a perspective view of an adaptor that includes a cover plate over the socket side of the adaptor.

FIG. 63 is a perspective view of an adaptor that includes a cover plate over the socket side of the adaptor. The cover plate 631 includes openings 632 that correspond to the openings below that are to receive pins of an electrical plug. The cover plate is movable to present those openings in two conditions. In a first condition the openings of the cover are out of register with the underlying openings. This is shown in FIG. 63. In this condition, a plug can not be inserted into the adaptor.

Figure 64:
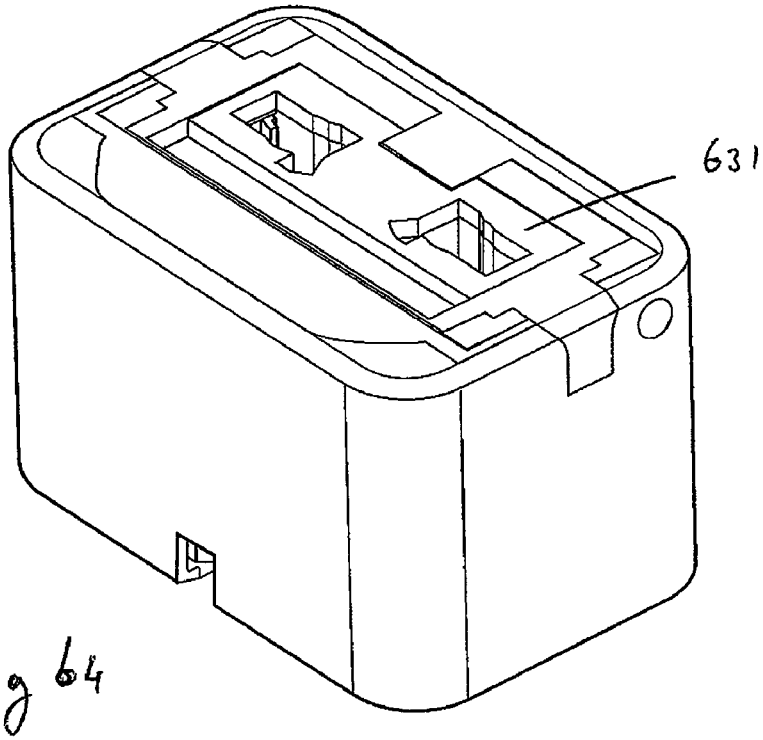
FIG. 64 shows the adaptor as shown in FIG. 63 wherein the cover plate has moved to allow the insertion of an electrical plug into the adaptor.

FIG. 64 shows the adaptor as shown in FIG. 63 wherein the cover plate has moved to allow the insertion of an electrical plug into the adaptor. Here the cover presents its openings in an in-register position relative to the underlying openings.

The cover may be acted upon by a spring 633 that biases the cover to the unregistered condition. A person wanting to insert a plug needs to move the cover against the bias in order to insert the plug.

The invention claimed is:

1. An electrical plug/socket adaptor for establishing an electrical connection between an electrical plug and an electrical socket, said adaptor comprising:

a housing including a cover pivotable between a closed position and an open position, an adaptor pin presenting zone, and at least one electrical plug receiving zone configured to receive the electrical plug, the electrical plug being a plug selected from a plug group consisting of at least one of a Euro pin electrical plug, a British pin electrical plug, a North America pin electrical plug, and an Australia pin electrical plug; and a first pair of adaptor pins and a second pair of adaptor pins positioned at the adaptor pin presenting zone, the first pair of adaptor pins configured to be operatively plugged into a first electrical socket selected from a socket group consisting of a Euro pin electrical socket, a British pin electrical socket, a North America pin electrical socket, and an Australia pin electrical socket; and the second pair of adaptor pins being configured to be operatively plugged into a second electrical socket selected from the socket group, the second electrical socket being a different member of the socket group than the first electrical socket, wherein each of the first pair of adaptor pins and the second pair of adaptor pins is independently pivotable relative to the housing between a storing position and an active position, the respective pair of adaptor pins in the active position, as an active pair of adaptor pins, projecting from said housing to allow insertion into the respective electrical socket, each of the first pair of adaptor pins and the second pair of adaptor pins is independently pivotable, only when the cover is in the open position, such that when the respective pair of adaptor pins is in the storing position and the cover is in the closed position the respective pair of adaptor pins is protected on all sides from an outside of the housing by the housing.

2. The adaptor as claimed in claim 1, wherein said at least one plug receiving zone comprises a plurality of adaptor sockets, each adaptor socket of the plurality of adaptor sockets configured to receive a pin of said respective electrical plug.

3. The adaptor as claimed in claim 1, wherein said at least one electrical plug receiving zone comprises a plurality of adaptor sockets, each socket configured to receive a pin of said electrical plug.

4. The adaptor as claimed in claim 3, wherein the at least one plug receiving zone is configured to receive and electrically connect with the pin of the respective electrical plug only when a corresponding pair of adaptor pins is positioned in the active position.

5. The adaptor as claimed in claim 3, wherein an electrical connection exists between each adaptor socket and the adaptor pins of the active pair of adaptor pins.

6. The adaptor as claimed in claim 5, wherein said adaptor complies with British Standard "BS1363 Plug" at the adaptor pin presenting zone of the adaptor.

7. The adaptor as claimed in claim 3, wherein said adaptor complies with British Standard "BS1363 Plug" at the adaptor pin presenting zone of the adaptor.

8. The adaptor as claimed in claim 1, wherein said adaptor complies with British Standard "BS1363 (part 1:1995)".

9. The adaptor as claimed in claim 1, wherein the housing includes an active adaptor pin presenting zone where the active pair of adaptor pins exits the housing, and wherein when the active pair of adaptor pins is pluggable into the British pin electrical socket, and a radial distance of at least 9.5 mm and no more than 15 mm exists from distal points of the active pair of adaptor pins to the active adaptor pin presenting zone.

10. The adaptor as claimed in claim 9, wherein the radial distance is no more than 14 mm.

11. The adaptor as claimed in claim 9, wherein the radial distance is no more than 13 mm.

12. The adaptor as claimed in claim 9, wherein the radial distance is no more than 12 mm.

13. The adaptor as claimed in claim 9, wherein the radial distance is no more than 11 mm.

14. The adaptor as claimed in claim 9, wherein the radial distance is no more than 10 mm.

15. The adaptor as claimed in claim 1, wherein said housing includes a base member, and the cover is pivotable between: (1) the closed position defining a pin enclosure within which the first pair of adaptor pins and the second pair of adaptor pins are retained in the closed position, and (2) the open position exposing said first pair of adaptor pins and the second pair of pins to allow the first pair of adaptor pins and the second pair of adaptor pins to be digitally manipulated by a user between the storing position and the active position.

16. The adaptor as claimed in claim 1, further comprising a third pair of adaptor pins configured to be operatively plugged into a third electrical socket selected from the socket group, and a fourth pair adaptor pins configured to be operatively plugged into a fourth electrical socket selected from the socket group, the third electrical socket and the fourth electrical socket being members of the socket group different from each other and from the first electrical socket and the second electrical socket.

17. The adaptor as claimed in claim 1, wherein the housing comprises a second cover, and the first pair of adaptor pins is configured to be plugged into the Euro pin electrical plug, and when the first pair of adaptor pins is in the storing position, the cover covers the first pair of adaptor pins.

18. The adaptor as claimed in claim 1, further comprising a third pair of adaptor pins configured to be operatively plugged into a third electrical socket selected from the socket group, and a fourth pair adaptor pins configured to be operatively plugged into a fourth electrical socket selected from the socket group, the third electrical socket and the fourth electrical socket being members of the socket group different from each other and from the first electrical socket and the second electrical socket, and wherein each of said third and fourth pair of adaptor pins is independently pivotable relative to the housing between the active position and the storing position.

19. The adaptor as claimed in claim 18, wherein the housing includes a housing core and a housing peripheral region about said housing core, said housing core extending inwardly from the adaptor pin presenting zone and said housing peripheral region, wherein said first pair of adaptor pins and said second pair of adaptor pins are mounted for rotation relative to said housing to pivot between the storing position and the active position, and are connected to the core solely at the adaptor pin presenting zone.

20. The adaptor as claimed in claim 19, wherein the housing peripheral region includes a surface as part of the adaptor pin presenting zone, the surface being of a peripheral shape and configuration that conforms to a British national standard for plug shape.

21. The adaptor as claimed in claim 1, wherein the housing when not in the closed position presents an interference member from the adaptor pin presenting zone, the interference member positioned and configured to prevent full engagement of any of the pairs of adaptor pins from engaging into the electrical socket.

22. The adaptor as claimed in claim 1, wherein the at least one plug receiving zone is configured to receive a plug for a DC voltage device, and further comprising a transformer positioned within said housing for transforming AC voltage received by said adaptor from said first electrical socket or the second electrical socket to DC voltage.

23. The adaptor as claimed in claim 1, wherein in the closed position said housing encloses said first pair of adaptor pins and said second pair of adaptor pins.

24. The adaptor as claimed in claim 1, wherein the adaptor is formed as an integrally connected device not requiring removal and/or attachment of any parts to pivot the cover between the closed position and the open position, or to pivot any of the first pair of adaptor pins and the second pair of adaptor pins between the storing position and the active position.

25. The adaptor as claimed in claim 1, further comprising an auxiliary plug receiving housing including a transformer for transforming AC voltage received from said first electrical socket or said second electrical socket to DC voltage.

26. The adaptor as claimed in claim 25, wherein said auxiliary plug receiving housing is configured to receive a USB plug.

27. The adaptor as claimed in claim 1, wherein said adaptor pin presenting zone is positioned to face an opposite direction from the electrical plug receiving zone.

28. The adaptor as claimed in claim 1, wherein said adaptor pin presenting zone includes a planar surface.

29. The adaptor as claimed in claim 1, wherein the electrical plug receiving zone is positioned at one face of the adaptor, said electrical plug receiving zone including two apertures that are mirror images of each other, each aperture being rectangular in form and having a perimeter to receive a British pin of the British pin electrical plug and each aperture including a first extension on said perimeter at a corner of said rectangle to allow receipt of an Australia pin of the Australia pin electrical plug and including a second extension on said perimeter to allow receipt of a North America pin of the North America pin electrical plug.

30. The adaptor as claimed in claim 1, wherein the adaptor includes a sliding safety cover including openings to allow insertion of electrical pins of a first electrical plug or a second electrical plug to be plugged into the adaptor, said sliding safety cover movable between a first position presenting said openings in register with openings of said housing for receiving said electrical pins and a second position presenting said openings out of register with said openings of said housing for preventing access of electrical pins into said housing.

31. The adaptor as claimed in claim 30, wherein said sliding safety cover when in the second position completely covers the openings of said housing.

32. The adaptor as claimed in 30, wherein said sliding safety cover is biased to the second position.

33. An electrical plug/socket adaptor for establishing an electrical connection between an electrical plug and an electrical socket, said adaptor comprising:

a housing including a cover pivotable between a closed position and an open position, an adaptor pin presenting zone, and at least one electrical plug receiving zone configured to receive the electrical plug. the electrical plug being a plug selected from a plug group consisting of at least one of a Euro pin electrical plug, a British pin electrical plug, a North America pin electrical plug, and an Australia pin electrical plug; and a first pair of adaptor pins and a second pair of adaptor pins positioned at the adaptor pin presenting zone, the first pair of adaptor pins configured to be operatively plugged into a first electrical socket selected from a socket group consisting of a Euro pin electrical socket, a British pin electrical socket, a North America pin electrical socket, and an Australia pin electrical socket; and the second pair of adaptor pins being configured to be operatively plugged into a second electrical socket selected from the socket group, the second electrical socket being a different member of the socket group than the first electrical socket, wherein each of the first pair of adaptor pins and the second pair of adaptor pins is independently pivotable relative to the housing between a storing position and an active position, the respective pair of adaptor pins in the active position, as an active pair of adaptor pins, projecting from said housing to allow insertion into the respective electrical socket, each of the first pair of adaptor pins and the second pair of adaptor pins is independently pivotable, only when the cover is in the open position, such that when the respective pair of adaptor pins is in the storing position and the cover is in the closed position the respective pair of adaptor pins is protected on all sides from an outside of the housing by the housing, wherein the housing defines two opposed end faces including a first end face and a second end face configured to receive the electrical plug, wherein said first end face includes a perimeter zone and an inner zone surrounded by said perimeter zone having an outer perimeter of the housing, wherein each of the first pair of adaptor pins and the second pair of adaptor pins when in the active position extends from said first end face only at said inner zone, said inner zone not being closer to the outer perimeter of the perimeter zone than (i) 9 mm or (ii) a distance required by a British national standard.

34. The adaptor as claimed in claim 33, wherein said national standard is BS1363 (part 1:1995).

35. The adaptor as claimed in claim 33, wherein each of said first pair of adaptor pins and the second pair of adaptor pins in said storing position is retained within said housing between said first end face and said second end face and a majority of each of the first pair of adaptor pins and the second pair of adaptor pins in the storing position lies beneath said perimeter zone of said first end face.

36. The adaptor as claimed in claim 33, wherein said housing is a multi part housing and includes a base member, and the cover is movable relative to said base member between at least two positions: (i) a closed position to cover all pairs of adaptor pins when in the storing position and to prevent movement of the pairs of adaptor pins between the storing position and the active position, and (ii) an open position exposing said pairs of adaptor pins when in the storing position to allow movement of the adaptor pins to the active position.

37. The adaptor as claimed in claim 36, wherein the housing when not in the closed position presents an interference member from the adaptor pin presenting zone, the interference member positioned and configured to prevent full engagement of any of the pairs of adaptor pins from engaging into the electrical socket.

38. The adaptor as claimed in claim in claim 36, further comprising an interference member movably engaged to the housing, wherein said cover is connected with the interference member, said interference member movable by said cover between (i) the storing position where said interference member does not project from said first end face, and (ii) the active position where said interference member does project from said first end face to prevent insertion of the active pair of adaptor pins into the first electrical socket or the second electrical socket whilst the elements of the adaptor otherwise covered by the cover are exposed.

39. The adaptor as claimed in claim 38, wherein said interference member is pivotally mounted to said housing.

40. The adaptor as claimed in claim 38, wherein said interference member is pivotally engaged to said cover.

41. The adaptor as claimed in claim 40, wherein the pivot axis of said cover with said interference member is parallel to but not coaxial with the pivot axis of said interference member with said housing.

42. The adaptor as claimed in claim 33, further comprising an articulation member positioned between said housing and said first pair of adaptor pins and projecting from said housing when the cover is in the open position, wherein the first pair of adaptor pins is configured to be plugged into the Euro pin electrical socket and is mounted from said housing by the articulation member.

43. The adaptor as claimed in claim 42, wherein the articulation member includes a parallelogram mechanism arrangement.

44. The adaptor as claimed in claim 43, wherein said parallelogram mechanism arrangement includes at least two arms, each having a distal end, each arm defining at the distal end an axis of rotation parallel to the axis of rotation of the other arms.

45. The adaptor as claimed in claim 44, wherein the at least two arms includes three arms.

46. The adaptor as claimed in claim 33, wherein said second end face includes a plurality of adaptor sockets shaped to receive the electrical plugs.

47. The adaptor as claimed in claim 33, wherein said second end face includes one pair of adaptor sockets, each socket configured to receive a pin of the electrical plugs.

48. The adaptor as claimed in claim 33, wherein said housing includes electrical link bars positioned to provide an electrical connection between the electrical plug receiving zone and said the active pair of adaptor pins, said link bars and said active pair of adaptor pins configured and positioned to establish said electrical connection when said active pair of adaptor pins is moved to the active position and to disconnect the electrical connection when the active pair of adaptor pins is in the storing position.

49. The adaptor as claimed in claim 33, wherein the housing includes a housing core and a housing peripheral region about said housing core, said housing core extending inwardly from the adaptor pin presenting zone and said housing peripheral region, wherein said first pair of adaptor pins and said second pair of adaptor pins are mounted for rotation relative to said housing to pivot between the storing position and the active position, and are connected to the core solely at the first end face.

50. The adaptor as claimed in claim 49, wherein the housing peripheral region has a peripheral shape and configuration that conforms to a British national standard for plug shape.

51. The adaptor as claimed in claim 33, wherein the adaptor is formed as an integrally connected device not requiring removal and/or attachment of any parts to pivot the cover between the closed position and the open position, or to pivot any of the first pair of adaptor pins and the second pair of adaptor pins between the storing position and the active position.

52. An electrical plug/socket adaptor for establishing an electrical connection between an electrical plug and an electrical socket, said adaptor comprising:

a housing including a cover pivotable between a closed position and an open position, an adaptor pin presenting zone, and at least one electrical plug receiving zone configured to receive the electrical plug, the electrical plug being a plug selected from a plug group consisting of at least one of a Euro pin electrical plug, a British pin electrical plug, a North America pin electrical plug, and an Australia pin electrical plug; and a first pair of adaptor pins and a second pair of adaptor pins positioned at the adaptor pin presenting zone, the first pair of adaptor pins configured to be operatively plugged into a first electrical socket selected from a socket group consisting of a Euro pin electrical socket, a British pin electrical socket, a North America pin electrical socket, and an Australia pin electrical socket; and the second pair of adaptor pins being configured to be operatively plugged into a second electrical socket selected from the socket group, the second electrical socket being a different member of the socket group than the first electrical socket, wherein each of the first pair of adaptor pins and the second pair of adaptor pins is independently pivotable relative to the housing between a storing position and an active position, the respective pair of adaptor pins in the active position, as an active pair of adaptor pins, projecting from said housing to allow insertion into the respective electrical socket, each of the first pair of adaptor pins and the second pair of adaptor pins is independently pivotable, only when the cover is in the open position, such that when the respective pair of adaptor pins is in the storing position and the cover is in the closed position the respective pair of adaptor pins is protected on all sides from an outside of the housing by the housing, wherein the at least one plug receiving zone is configured to receive a plug for a DC voltage device, and a transformer positioned within said housing for transforming AC voltage received by said adaptor from said first electrical socket or the second electrical socket to DC voltage.

53. An electrical plug/socket adaptor for establishing an electrical connection between an electrical plug and an electrical socket, said adaptor comprising:

a housing including a cover pivotable between a closed position and an open position, an adaptor pin presenting zone, and at least one electrical plug receiving zone configured to receive the electrical plug, the electrical plug being a plug selected from a plug group consisting of at least one of a Euro pin electrical plug, a British pin electrical plug, a North America pin electrical plug, and an Australia pin electrical plug; and a first pair of adaptor pins and a second pair of adaptor pins positioned at the adaptor pin presenting zone, the first pair of adaptor pins configured to be operatively plugged into a first electrical socket selected from a socket group consisting of a Euro pin electrical socket, a British pin electrical socket, a North America pin electrical socket, and an Australia pin electrical socket; and the second pair of adaptor pins being configured to be operatively plugged into a second electrical socket selected from the socket group, the second electrical socket being a different member of the socket group than the first electrical socket, wherein each of the first pair of adaptor pins and the second pair of adaptor pins is independently pivotable relative to the housing between a storing position and an active position, the respective pair of adaptor pins in the active position, as an active pair of adaptor pins, projecting from said housing to allow insertion into the respective electrical socket, each of the first pair of adaptor pins and the second pair of adaptor pins is independently pivotable, only when the cover is in the open position, such that when the respective pair of adaptor pins is in the storing position and the cover is in the closed position the respective pair of adaptor pins is protected on all sides from an outside of the housing by the housing, a housing and the housing cover defining an interior space defined by two opposed planar adaptor end faces, the axes of rotation of said first pair of adaptor pins and the second pair of adaptor pins lying in a plane or planes parallel to each other and parallel to the end faces of said housing, the interior space having a width between said opposed planar adaptor end faces to just accommodate the first pair of adaptor pins and the second pair of adaptor pins in the stored position.

54. The electrical adaptor as claimed in claim 53, wherein the housing includes a housing core and a housing peripheral region about said housing core, said housing core extending inwardly from the first end face and said housing peripheral region, wherein said first pair of adaptor pins and said second pair of adaptor pins are mounted for rotation relative to said housing to pivot between the storing position and the active position, and are connected to the core solely at the adaptor pin presenting zone.

55. The adaptor as claimed in claim 54, wherein the periphery of housing peripheral region is of a peripheral shape and configuration that conforms to a British national standard for plug shape.

56. An electrical plug/socket adaptor for establishing an electrical connection between an electrical plug and an electrical socket, said adaptor comprising:

a housing including a cover pivotable between a closed position and an open position, an adaptor pin presenting zone, and at least one electrical plug receiving zone configured to receive the electrical plug, the electrical plug being a plug selected from a plug group consisting of at least one of a Euro pin electrical plug, a British pin electrical plug, a North America pin electrical plug, and an Australia pin electrical plug; and a first pair of adaptor pins and a second pair of adaptor pins positioned at the adaptor pin presenting zone, the first pair of adaptor pins configured to be operatively plugged into a first electrical socket selected from a socket group consisting of a Euro pin electrical socket, a British pin electrical socket, a North America pin electrical socket, and an Australia pin electrical socket; and the second pair of adaptor pins being configured to be operatively plugged into a second electrical socket selected from the socket group, the second electrical socket being a different member of the socket group than the first electrical socket, wherein each of the first pair of adaptor pins and the second pair of adaptor pins is independently pivotable relative to the housing between a storing position and an active position, the respective pair of adaptor pins in the active position, as an active pair of adaptor pins, projecting from said housing to allow insertion into the respective electrical socket, each of the first pair of adaptor pins and the second pair of adaptor pins is independently pivotable, only when the cover is in the open position, such that when the respective pair of adaptor pins is in the storing position and the cover is in the closed position the respective pair of adaptor pins is protected on all sides from an outside of the housing by the housing;

an articulation member positioned between said housing and said first pair of adaptor pins and projecting from said housing when the cover is in the open position, wherein the first pair of adaptor pins is configured to be plugged into the Euro pin electrical socket and is mounted from said housing by the articulation member positioned between said housing and said first pair of adaptor pins and projecting from said housing when the cover is in the open position.

57. The adaptor as claimed in claim 56, wherein said plug arrangement includes two euro pin electrical terminals pivotally engaged to an intermediate member positioned intermediate of said electrical terminals and said housing, said intermediate member pivotally engaged to said housing on an axis parallel to the axis of pivot of said electrical terminals.

58. The adaptor as claimed in claim 57, the electrical terminals including a first electrical terminal including a first lever and a second electrical terminal comprising a second lever; and the adaptor further comprising a first link bar extending between said housing and said first electrical terminal and engaging in a pivotable manner: (i) said electrical terminal at the first lever, the first lever positioned to actuate pivotal movement of said first electrical terminal relative to said intermediate member, and (ii) said housing; and a second link bar extending between said housing and said electrical terminal and engaging in a pivotable manner: (i) said second electrical terminal at the second lever, the second lever positioned to actuate pivotal movement of said second electrical terminal relative to said intermediate member, and (ii) said housing.

59. The adaptor as claimed in claim 58, wherein said first link bar has two pivot axes, both pivot axes parallel to the two pivot axes of the second link bar.

60. The adaptor as claimed in claim 59, wherein the pivot axis of the first link bar with the first electrical terminal is parallel to but not coaxial with the pivot axis of the second link bar with the second electrical terminal.

61. The adaptor as claimed in claim 59, wherein the pivot axis of the first link bar with the housing is parallel to but not coaxial with the pivot axis of the second link bar with the housing.

62. The adaptor as claimed in claim 59, wherein the pivot axis of the intermediate member with said housing is parallel to but not coaxial with the pivot axis of the first link bar with the housing nor coaxial with the pivot axis of the second link bar with the housing.

63. The adaptor as claimed in claim 59, wherein the pivot axis of the intermediate member is parallel to and coaxial with each of said electrical terminals, is parallel to but not coaxial with the pivot axis of the first link bar with the first electrical terminal and is not coaxial with the pivot axis of the second link bar with the second electrical terminal.

* * * * *